US010526822B2

(12) United States Patent
Kitamura et al.

(10) Patent No.: US 10,526,822 B2
(45) Date of Patent: Jan. 7, 2020

(54) LID LOCKING DEVICE

(71) Applicants: AISIN SEIKI KABUSHIKI KAISHA, Kariya-shi (JP); TOYOTA JIDOSHA KABUSHIKI KAISHA, Toyota-shi (JP)

(72) Inventors: Toshihiro Kitamura, Nagoya (JP); Takumi Niwa, Kariya (JP); Tatsuya Shimizu, Okazaki (JP); Masayuki Nomura, Nagakute (JP); Yoshichika Ito, Toyoake (JP)

(73) Assignees: AISIN SEIKI KABUSHIKI KAISHA, Kariya-shi (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 1188 days.

(21) Appl. No.: 14/525,872

(22) Filed: Oct. 28, 2014

(65) Prior Publication Data

US 2015/0114052 A1 Apr. 30, 2015

(30) Foreign Application Priority Data

Oct. 31, 2013 (JP) ..... 2013-226342

(51) Int. Cl.
*E05B 65/00* (2006.01)
*E05B 81/56* (2014.01)
*E05B 83/28* (2014.01)

(52) U.S. Cl.
CPC ..... *E05B 83/28* (2013.01); *E05B 65/00* (2013.01); *E05B 81/56* (2013.01); *Y10T 70/554* (2015.04); *Y10T 70/625* (2015.04); *Y10T 70/7062* (2015.04)

(58) Field of Classification Search
CPC ..... E05B 83/28; E05B 81/18; E05B 77/38; E05B 81/06; E05B 81/66; E05B 85/02;
(Continued)

(56) References Cited

U.S. PATENT DOCUMENTS 8,616,609 B2 12/2013 Ogata et al.
8,845,001 B2 * 9/2014 Kotama ..... B60L 11/1818 296/97.22

(Continued)

FOREIGN PATENT DOCUMENTS

EP 2 182 148 A2 5/2010
EP 2 182 148 A3 5/2010

(Continued)

OTHER PUBLICATIONS

Office Action dated Aug. 19, 2015 in Japanese Patent Application No. 2013-226342 (with English language translation).

*Primary Examiner* — Kristina R Fulton
*Assistant Examiner* — Thomas L Neubauer
(74) *Attorney, Agent, or Firm* — Oblon, McClelland, Maier & Neustadt, L.L.P.

(57) ABSTRACT

A lid locking device of the present invention is provided with a power transmission mechanism which includes a worm gear, a worm wheel, a pressurizing protrusion portion, a pressurized face and an interference avoiding space between a motor and a locking member. The power transmitting mechanism transmits backward-driving power which allows the locking member to move backward to an unlocked position from the motor to the locking member but does not transmit the power from the locking member to the motor and cuts off the power. That is, the backward driving power received by the locking member from an engagement protrusion piece of a lid on closing the lid is cut off by the power transmitting mechanism and not transmitted to the motor.

21 Claims, 22 Drawing Sheets

(58) Field of Classification Search
CPC ..... E05B 83/34; E05B 65/00; E05B 81/56; E05B 81/54; Y10T 70/554; Y10T 70/625; Y10T 70/7062
See application file for complete search history.

(56) References Cited

U.S. PATENT DOCUMENTS

| | | | | |
|---|---|---|---|---|
| 2012/0248792 | A1 | 10/2012 | Ban et al. | |
| 2012/0274084 | A1* | 11/2012 | Rosales | E05B 15/04 292/196 |
| 2013/0341938 | A1 | 12/2013 | Niwa et al. | |

FOREIGN PATENT DOCUMENTS

| | | | |
|---|---|---|---|
| JP | 2002-240581 | A | 8/2002 |
| JP | 2009-144448 | A | 7/2009 |
| JP | 2010-106437 | A | 5/2010 |
| JP | 2010-106438 | A | 5/2010 |
| JP | 2012-30750 | | 2/2012 |
| JP | 2012-77507 | A | 4/2012 |
| JP | 2012-215055 | A | 11/2012 |
| JP | 2013-112144 | A | 6/2013 |

* cited by examiner

LID LOCKING DEVICE

BACKGROUND OF THE INVENTION

1. Field of the Invention

The present invention relates to a lid locking device which locks a lid of a vehicle in a closed state by using a locking member and, in particular, relates to a lid locking device for locking a lid which closes an opening of a recessed portion at which innermost side, a fuel filler opening of the vehicle, a power receiving connector and other energy obtaining portions are provided.

2. Description of the Related Art

Conventionally, as this type of lid locking device, there is known a device which is provided with a motor that is gear-coupled to a locking member and a spring which urges the locking member forward. In the lid locking device, in a process of closing a lid, a locking member is pressed by a locking engaging portion of the lid, moves backward to an unlocked position and then moves forward to a locking position and locks the lid in a closed state. Further, the device allows the locking member to move backward to the unlocked position by the power of a motor, thus enabling to unlock the lid (refer to Japanese Published Unexamined Patent Application No. 2012-30750 (FIG. 15, FIG. 16, [0063] to [0067]), for example).

However, in the above-described conventional lid locking device, the motor and a group of gears rotate together with the locking member when the lid is closed, thus resulting in an increased resistance of the lid. This poses a problem.

The present invention has been made in view of the above situation, an object of which is to provide a lid locking device which is capable of decreasing resistance when a lid is closed, as compared with a conventional device.

SUMMARY OF THE INVENTION

A lid locking device according to the present invention for attaining the above-described object is provided with a housing which is arranged so as to be fixed on a vehicle, a locking member which is movably assembled to the housing, urged to an origin position in its moving range and arranged so as to move backward in a process of closing a lid of a vehicle by being pressed by a locking engaging portion provided on the lid and then move forward to a locking position before the origin position, thereby locking the lid in a closed state, a drive source which is assembled to the housing and outputs power for allowing the locking member at the locking position to move backward to the unlocked position at which the lid is unlocked, a power transmitting mechanism which connects between the drive source and the locking member and transmits power from the drive source to the locking member when the locking member is allowed to move backward to the unlocked position but does not transmit power from the locking member to the drive source and cuts off the power, a detection switch which is assembled to the housing and turned on or off depending on whether the locking member is positioned at the origin position or not, and a switch contact portion which is provided integrally on the locking member and comes into contact with the detection switch or releases the contact when the locking member moves to the origin position, thereby turning the detection switch on or off.

In the present inventions, "front" or "forward" contained in expressions such as "at the front" or "move forward" expresses for the sake of convenience one direction in which the locking member moves, whereas "rear" or "backward" contained in expressions such as "in the rear of" or "move backward" expresses a direction opposite to the above-described expression of "forward." These expressions such as "front" "forward," "rear" and "backward" have nothing to do with the front and the rear of a vehicle

DESCRIPTION OF THE PREFERRED EMBODIMENT(S)

Figure 1:
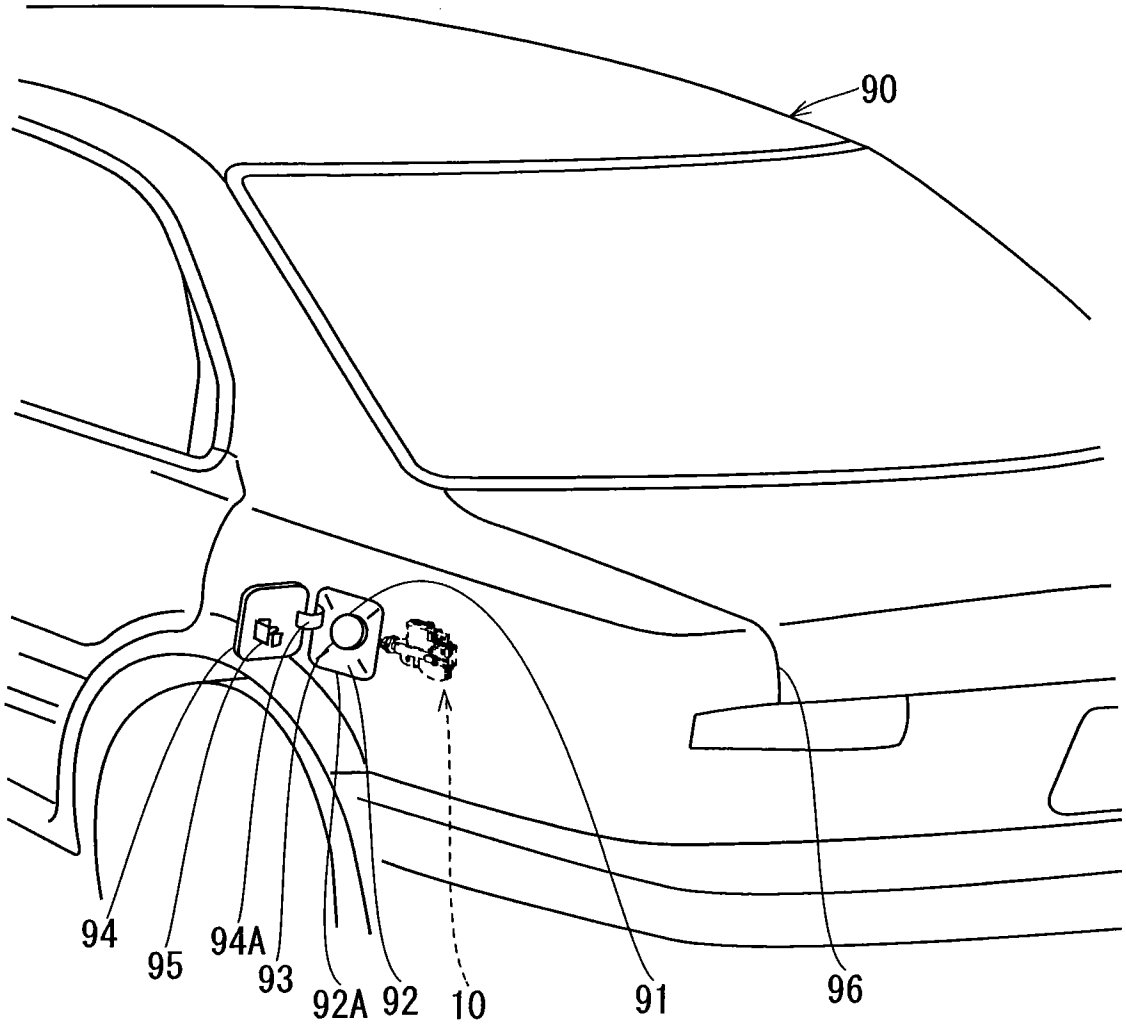
FIG. 1 is a perspective view of a vehicle on which a lid locking device of a First Embodiment of the present invention is mounted.

Hereinafter, a description will be given of one embodiment of the present invention by referring to FIG. 1 to FIG. 18. A fuel filler opening 91 of a vehicle 90 shown in FIG. 1 is disposed on an innermost side of a recessed portion 92 which is formed so as to be depressed at a position close to the rear of a side face of the vehicle 90 and normally closed by a fuel filler opening cap 93. An open port 92A of the recessed portion 92 is also normally closed by a lid 94. The lid 94 is fixed at the tip of a curved arm 94A coupled to the front inner face of the recessed portion 92 so as to rotate and opened outside the recessed portion 92. Further, when the lid 94 is closed, an outer face of the lid 94 is flush with an entire outer face of the vehicle 90. Still further, the lid 94 is urged so as to be opened by an elastic member which is not illustrated.

In addition, in describing each individual position and each individual component given below, the front side of the vehicle 90 is simply referred to as "the front," the opposite side thereof is simply referred to as "the rear," and a transverse direction of the vehicle 90 is simply referred to as "transverse direction."

Figure 2:
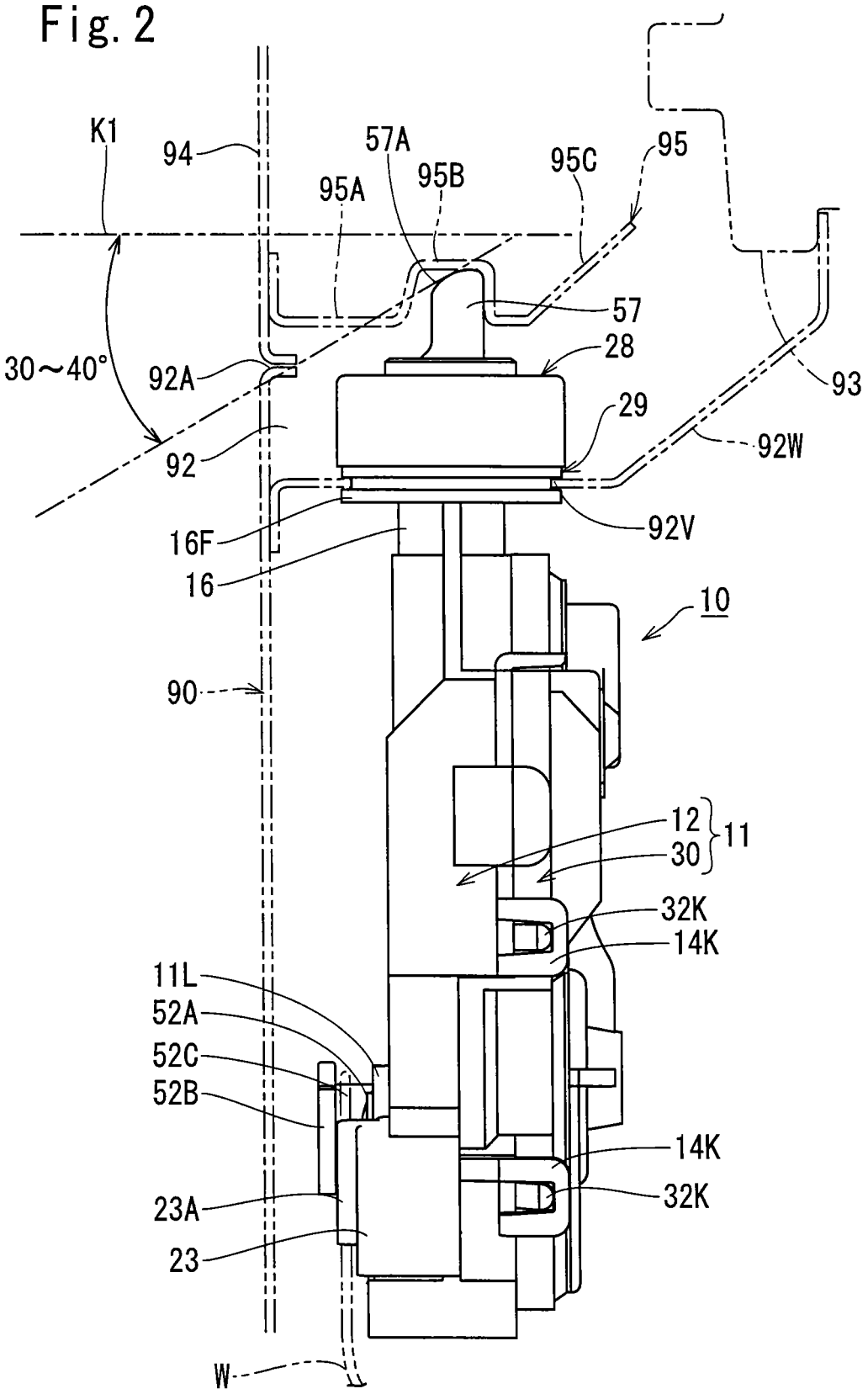
FIG. 2 is a plan view of the lid locking device.

An engagement protrusion piece 95 (corresponding to the "locking engaging portion" of the present invention) protrudes into the recessed portion 92 from an inner face of the lid 94. As shown in FIG. 2, the engagement protrusion piece 95 is provided with a rod abutting portion 95A which protrudes from the inner face of the lid 94 in a substantially perpendicular manner, an engagement recessed portion 95B which is formed by bending a position close to the tip of the rod abutting portion 95A to the front in an angular groove shape, and a tip guide portion 95C which extends obliquely forward from a tip portion of the rod abutting portion 95A to the front. A lid locking device 10 of the present invention is provided at the vehicle 90 in order to engage with the engagement protrusion piece 95 to lock the lid 94 in a closed state (a state shown in FIG. 2).

The lid locking device 10 is constructed by assembling a plurality of components to a housing 11 and assembled in the rearward of an internal side wall 92W of the recessed portion 92. Only a front end portion of the lid locking device 10 protrudes forward from an inner side face in the rear of the recessed portion 92 by way of a through hole 92V formed on the internal side wall 92W.

Figure 3:
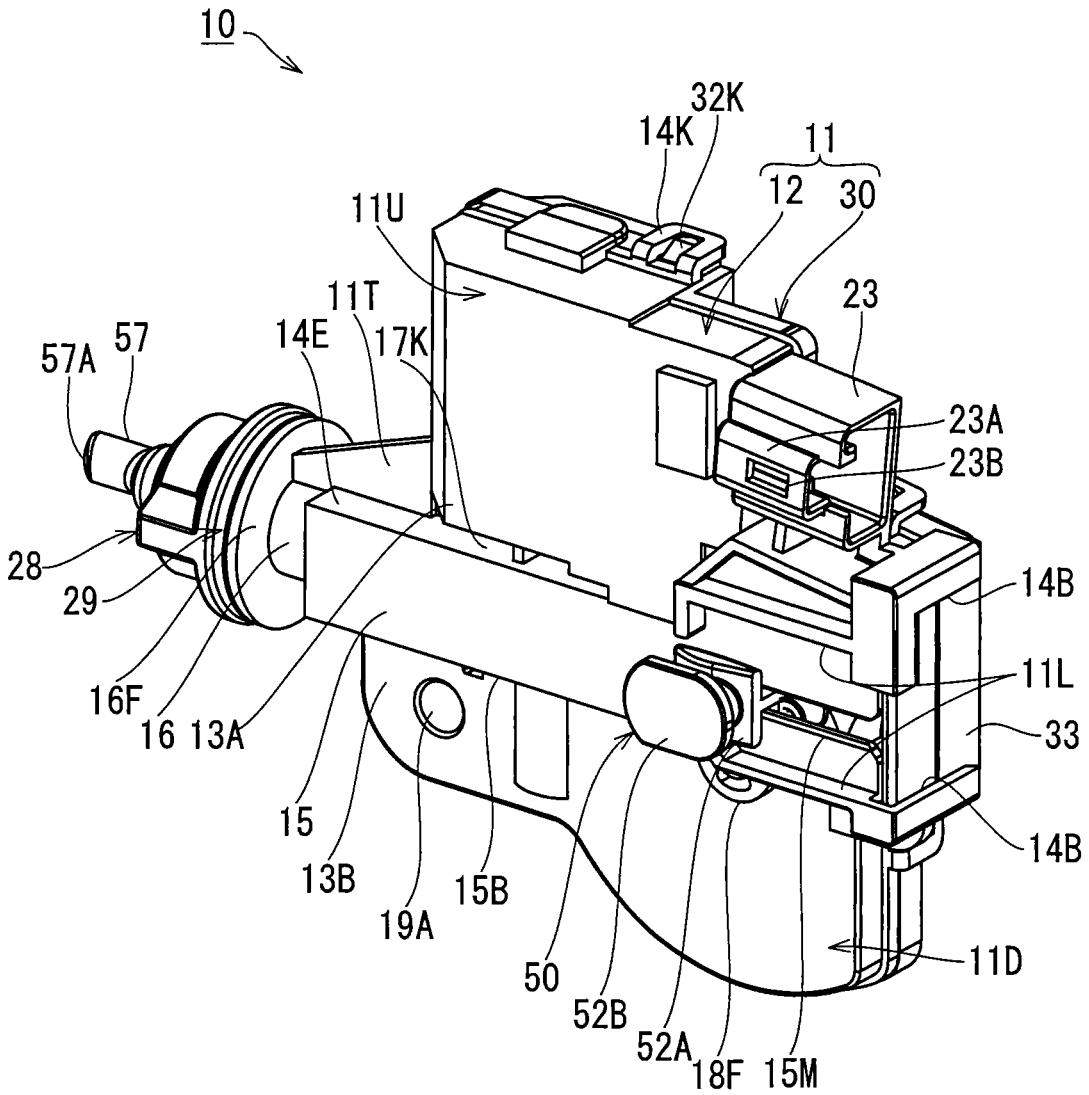
FIG. 3 is a perspective view of the lid locking device when viewed obliquely from the rear.
Figure 4:
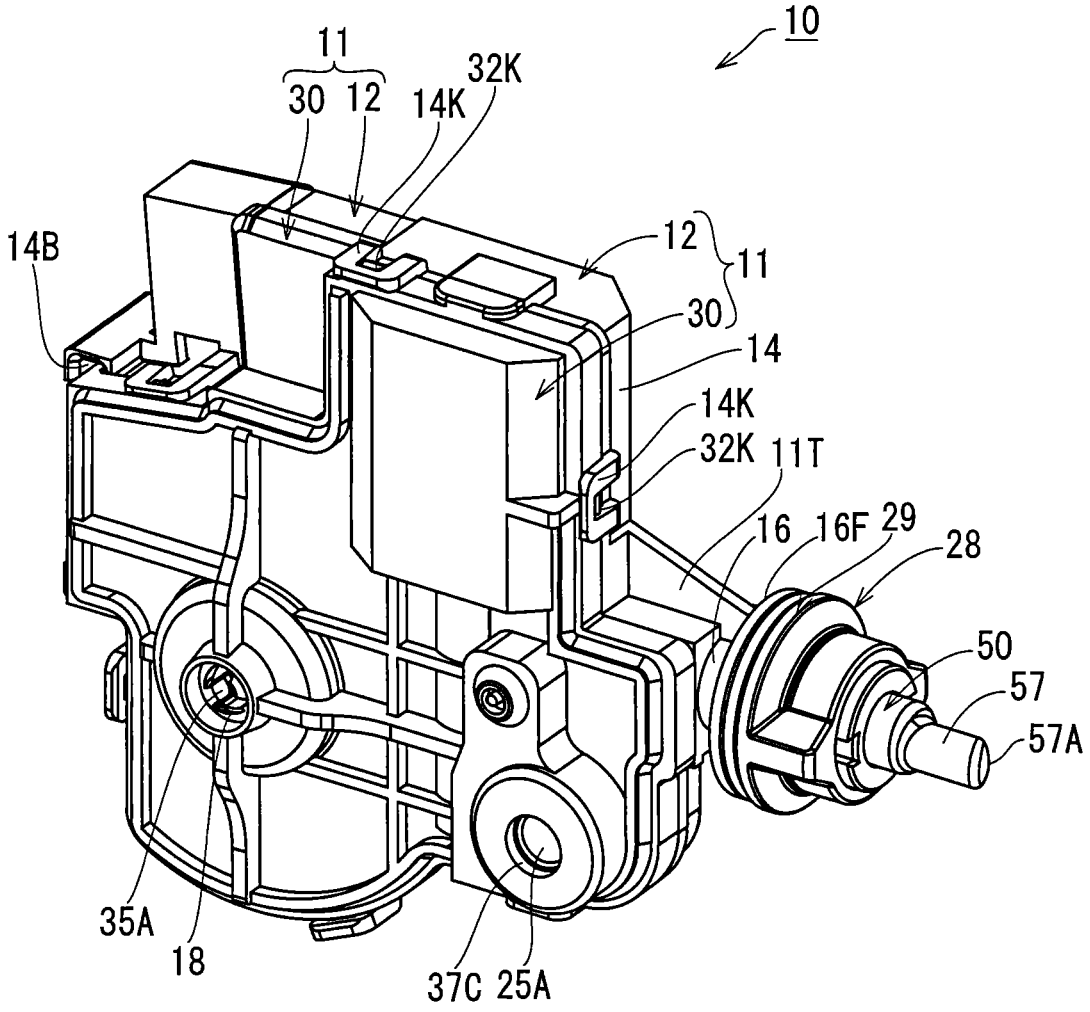
FIG. 4 is a perspective view of the lid locking device when viewed obliquely from the front.
Figure 5:
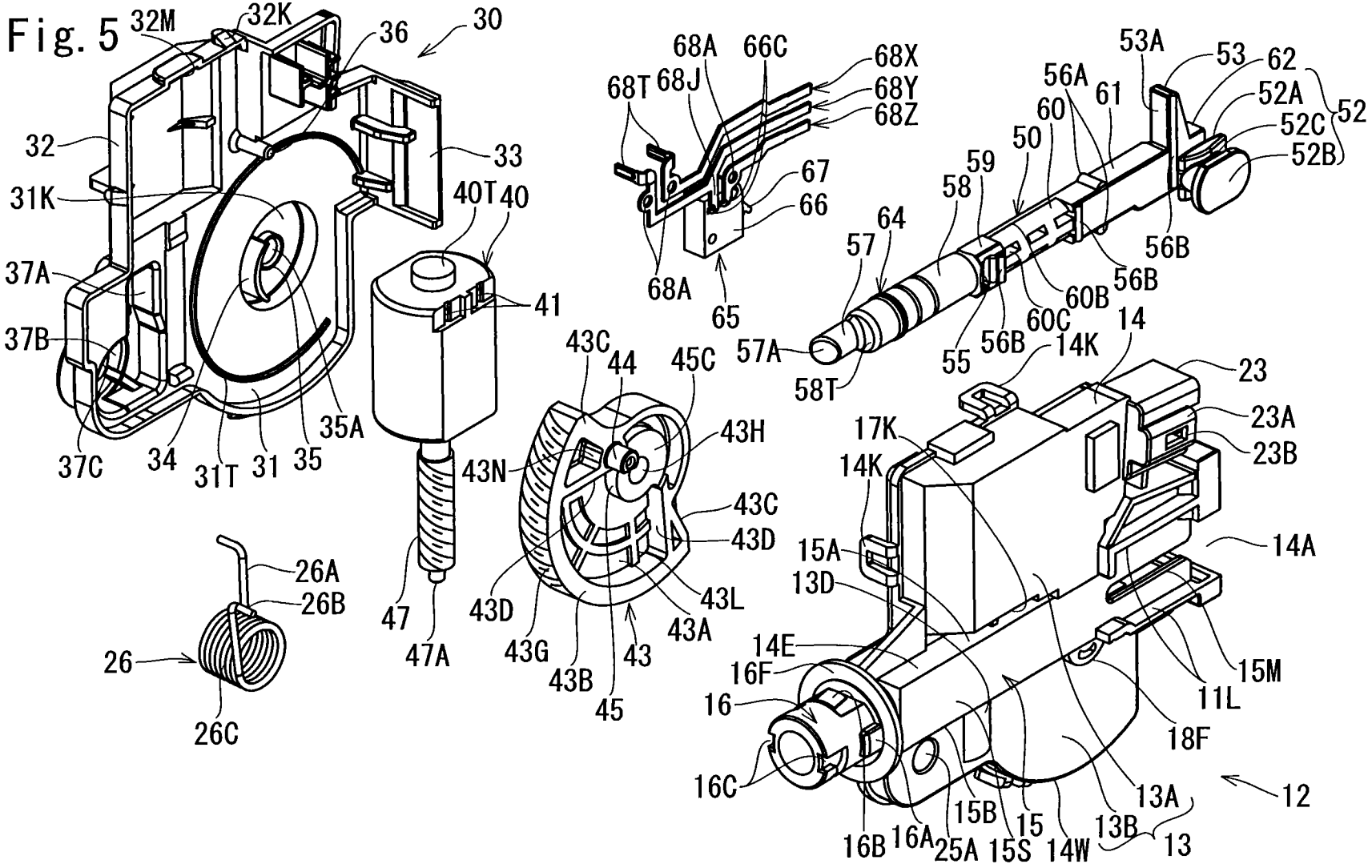
FIG. 5 is an exploded perspective view of the lid locking device.

As shown in FIG. 3 and FIG. 4, the housing 11 of the lid locking device 10 is structured to be a casing which is flat in the transverse direction and also divided into two portions, that is, a main housing 12 and a sub-housing 30 in the transverse direction. As shown in FIG. 5, the main housing 12 is structured in such a manner that a main side wall 14 protrudes from an outer peripheral portion of a main plate portion 13. On the other hand, the sub-housing 30 is structured in such a manner that a sub-side wall 32 lower than the main side wall 14 protrudes from an outer peripheral portion of a sub-plate portion 31 opposite to the main plate portion 13. The sub-housing 30 is used as a lid closing a space surrounded by the main side wall 14 of the main housing 12. Further, a portal locking piece 14K protrudes toward the sub-housing 30 from a plurality of positions on an outer face of the main side wall 14. Correspondingly thereto, a locking protrusion 32K is provided on a plurality of positions on an outer face of the sub-side wall 32. As shown in FIG. 3, the main housing 12 and the sub-housing 30 are held in a united state by the engagement between the locking piece 14K and the locking protrusion 32K.

Figure 6:
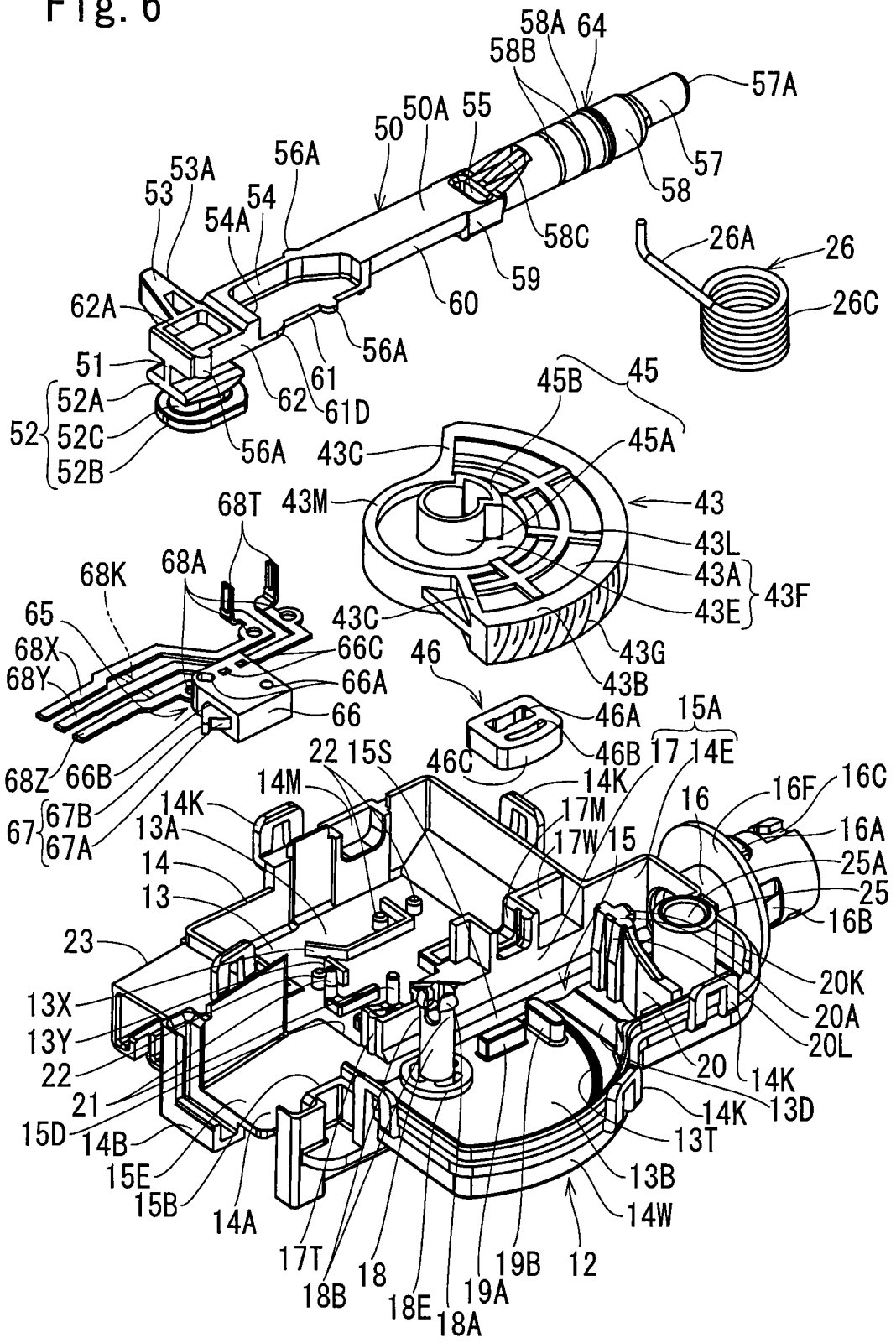
FIG. 6 is an exploded perspective view of the lid locking device.

As shown in FIG. 6, a guide groove portion 15 formed in an angular groove shape to extend in a front-back direction is provided at substantially the center in a vertical direction of the main plate portion 13. The main plate portion 13 is demarcated by the guide groove portion 15 into an upper main plate portion 13A and a lower main plate portion 13B.

More specifically, the main plate portion 13 is such that a vertical middle portion thereof is bent in a step-wise manner and a step portion thereof is given as a lower groove side wall 15B of a pair of groove side walls 15A, 15B (refer to FIG. 5) opposed to each other in the vertical direction at the guide groove portion 15. A lower portion from the groove side wall 15B is given as a lower main plate portion 13B which is shifted in a stepwise manner toward the sub-plate portion 31 with respect to an upper portion. Further, a vertical partition wall 17 which is opposed from above to the lower groove side wall 15B and also extends in the front-back direction protrudes from an inner face of the main plate portion 13. A groove side wall 15A on an upper side of the guide groove portion 15 is composed of the vertical partition wall 17 and a groove constituting portion 14E which is a part of the main side wall 14 and extends on a front extension line of the vertical partition wall 17.

The vertical partition wall 17 is opposed to the lower groove side wall 15B in a range from a position close to the rear end thereof to a position close to the front end thereof, and the groove constituting portion 14E of the main side wall 14 extending forward of the vertical partition wall 17 is opposed to the lower groove side wall 15B in a range from the position close to the front end thereof to the front end thereof. Further, the lower groove side wall 15B extends backward longer than the upper groove side wall 15A. An upper portion from the vertical partition wall 17 of the main plate portion 13 is given as the above-described upper main plate portion 13A, and the upper main plate portion 13A is shifted toward the side slightly away from the sub-housing 30 with respect to a groove bottom wall 15S of the guide groove portion 15. Further, a contacting protruding strip 17T which has a semi-circular cross section and extends in the transverse direction (corresponding to "stopper" of the present invention) is formed on a rear end face of the vertical partition wall 17. Still further, a motor opposing wall 17W protrudes toward the sub-housing 30 from the front part of the vertical partition wall 17, and a motor positioning groove 17M is formed so as to cut a middle portion of the motor opposing wall 17W.

In addition, the vertical partition wall 17 is made thicker than the main side wall 14, and a void portion 17K which is opened toward an outer face of the main plate portion 13 is formed midway in the thickness direction thereof, as shown in FIG. 5.

As shown in FIG. 6, the groove bottom wall 15S of the guide groove portion 15 extends continuously to the rear end of the lower groove side wall 15B. Further, a rear end flat-plate portion 15E obtained by extending the groove bottom wall 15S upward is provided in the rear of the vertical partition wall 17. An upper end portion of the rear end flat-plate portion 15E is positioned midway in the vertical direction of the upper main plate portion 13A. A step portion 15D between the rear end flat-plate portion 15E and the upper main plate portion 13A extends straight upward from the rear end portion of the vertical partition wall 17, then bends backward at a right angle and extends up to an intermediate portion of the upper edge portion of the vertical partition wall 17.

At the upper portion from the guide groove portion 15, the main side wall 14 extends forward along the upper edge portion of the rear end flat-plate portion 15E to a middle point from the rear end thereof, extending upward, forward and downward from there along a rear edge portion, an upper edge portion and a front end edge of the upper main plate portion 13A and connecting with the front end portion of the vertical partition wall 17. As described previously, the groove constituting portion 14E of the main side wall 14 extends to the front of the vertical partition wall 17, constitutes a part of the upper groove side wall 15A. The front end portion of the groove constituting portion 14E is bent at a right angle, coming across the front end of the guide groove portion 15.

The main side wall 14 which is a portion below the guide groove portion 15 is provided at a position close to the rear end thereof with a gear cover curved portion 14W which swells downward. Further, the main side wall 14 extends forward from the front end portion of the gear cover curved portion 14W and then moves upward in the perpendicular direction, thereby connecting with the front end portion of the lower groove side wall 15B. The main side wall 14 also extends from the rear end portion of the gear cover curved portion 14W upward in the perpendicular direction and then extends backward along the lower groove side wall 15B.

Figure 8:
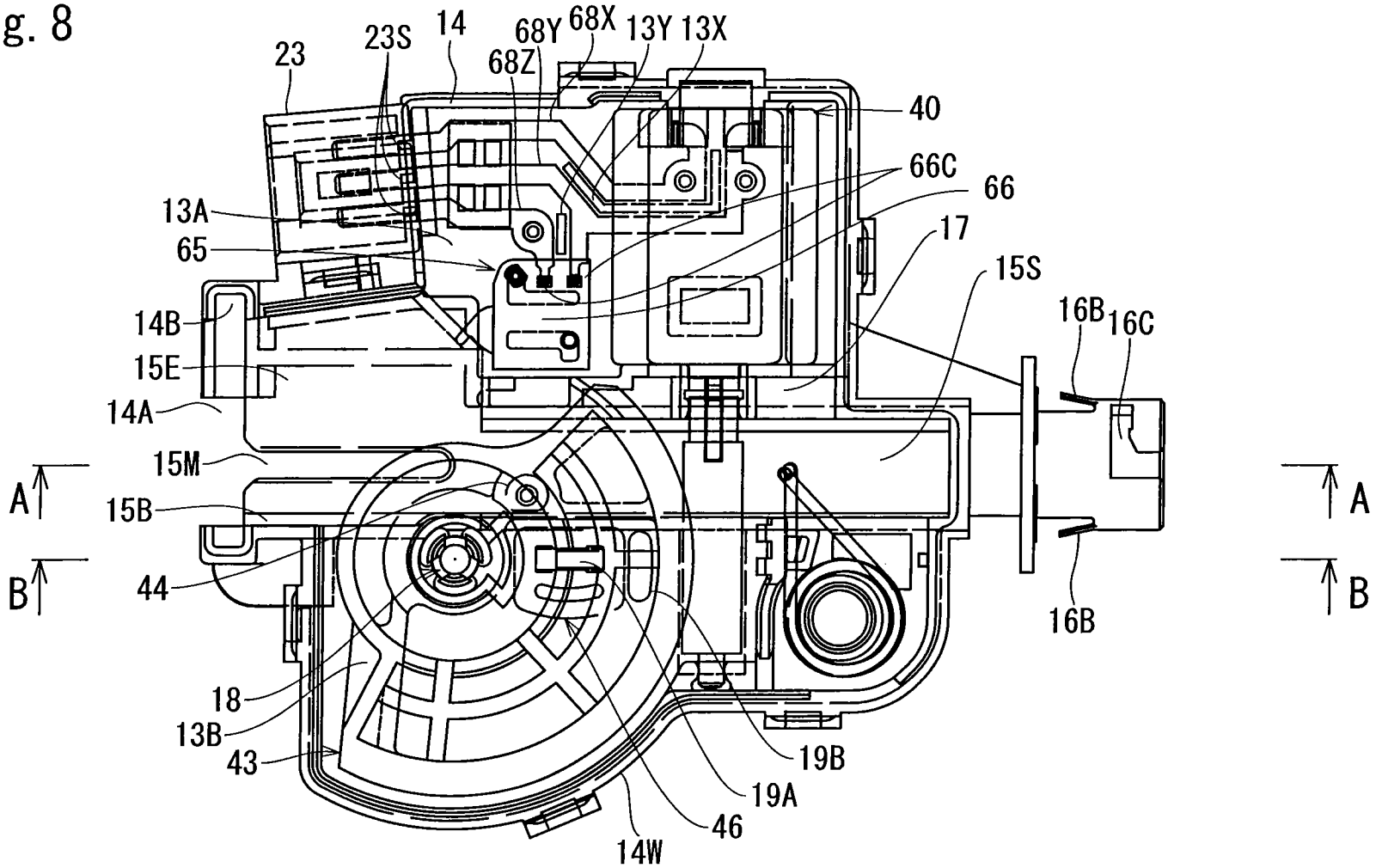
FIG. 8 is an internal side view of the lid locking device.

A rod passing port 14A formed by cutting the main side wall 14 is provided in the rear of the guide groove portion 15 and also in the rear of the rear end flat-plate portion 15E. Further, as shown in FIG. 8, at the center of the groove bottom wall 15S in the width direction, a guide slit 15M extends from the rear end of the groove bottom wall 15S to a position before the vertical partition wall 17. As shown in FIG. 3, the rod passing port 14A (refer to FIG. 6) and a rear end opening of the guide slit 15M are closed by a closing portion 33 which protrudes from the rear end portion of the sub-housing 30 to the main housing 12. Further, as shown in FIG. 6, a protrusion-piece engaging groove 14B with which an edge portion of the closing portion 33 is engaged in a sliding manner is formed at a pair of rear end edges of the main side wall 14 which oppose each other vertically across the rod passing port 14A of the main housing 12 and at a part of the rear end edge of the rear end flat-plate portion 15E.

In addition, as shown in FIG. 3, a reinforcing rib 11L which extends on both sides of the guide slit 15M in the front-back direction is provided on an outer face of the main housing 12.

As shown in FIG. 8, a substantially square tube-shaped male connector hood 23 (corresponding to the "connector portion" of the present invention) protrudes from an outer face of the main side wall 14 above the rear end flat-plate portion 15E. Further, a plurality of bus bar insertion slits 23S for inserting a first to a third bus bar 68X, 68Y and 68Z to be described later are formed at a part surrounded by the male connector hood 23 of the main side wall 14.

In addition, as shown in FIG. 3, on one side wall of the male connector hood 23, there is formed an angular groove portion 23A which extends in the front-back direction, with a middle portion of the side wall being raised outside in the width direction. A rectangular locking hole 23B is formed at a middle portion of the angular groove portion 23A. A female connector (not illustrated) is fitted into the male connector hood 23 and a protrusion of an engagement arm provided on the female connector is locked into a locking hole 23B.

As shown in FIG. 6, a tip cylindrical portion 16 extends forward from an outer face of the main side wall 14 which is a part that comes across the front end of the guide groove portion 15, and an inner space of the tip cylindrical portion 16 is communicatively connected to an inner space of the guide groove portion 15. Further, a disk shaped flange 16F swells out from a middle point of the tip cylindrical portion 16 in the axial direction. As shown in FIG. 5, a pair of engagement protrusion portions 16A and a pair of engagement warping pieces 16B are formed on an outer circumferential face of a part forward from the flange 16F in the tip cylindrical portion 16, and a pair of engaging grooves 160, 16C are formed at a tip which is away from the flange 16F. In addition, as shown in FIG. 4, a space between the main side wall 14 provided at the front end portion of the upper main plate portion 13A and a part rearward from the flange 16F in the tip cylindrical portion 16 are connected by the reinforcing rib 11T.

Figure 7:
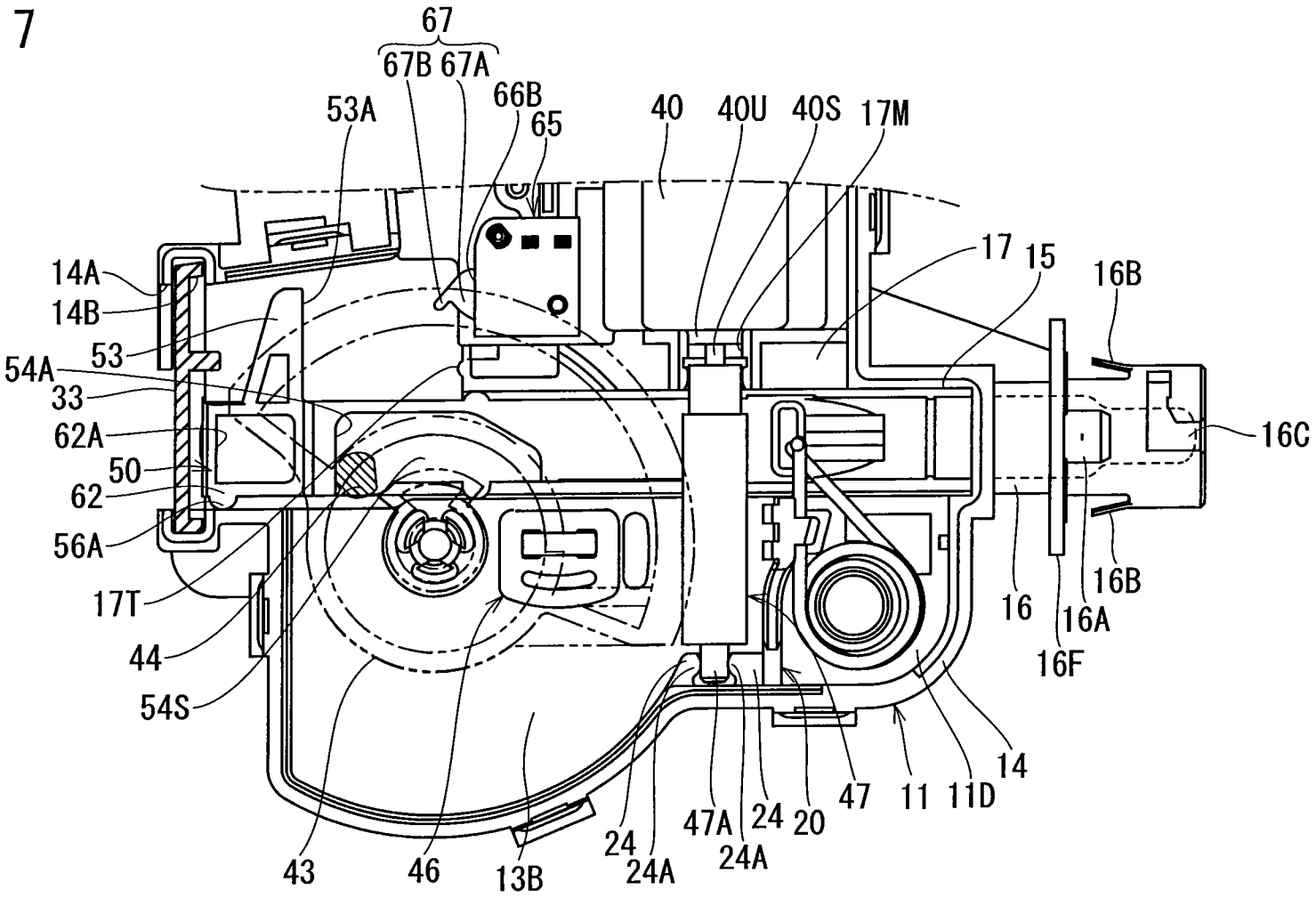
FIG. 7 is an internal side view of the lid locking device in a state that a locking member is positioned before a rear-end limit position.

The engagement protrusion portion 16A and the engagement warping piece 16B are alternately arrayed, with an interval of 90 degrees in a circumferential direction of the tip cylindrical portion 16. Further, the engagement protrusion portion 16A assumes a rectangular shape when viewed in the diametrical direction of the tip cylindrical portion 16 and protrudes as a whole in a stepwise manner from the outer circumferential face of the tip cylindrical portion 16. Still further, the rear end of the engagement protrusion portion 16A is connected to the flange 16F (refer to FIG. 7). On the other hand, as shown in FIG. 7, the engagement warping piece 16B is given as a protrusion structure which gradually swells out to the rear from an outer circumferential face of the tip cylindrical portion 16. Further, as shown in FIG. 5, a pair of engaging grooves 16C, 16C are formed in an axial symmetry at two positions which are spaced away at 180 degrees in a circumferential direction of the tip cylindrical portion 16. As shown in FIG. 7, each engaging groove 16C assumes an L-letter shape which extends straight from the tip of the tip cylindrical portion 16 to the rear in an axial direction and bends at right angle.

A retaining sleeve 28 shown in FIG. 2 is fitted outside the tip of the tip cylindrical portion 16, and a pair of engagement protrusion portions (not illustrated) formed on an inner face of the retaining sleeve 28 are engaged with the engaging grooves 16C, 16C and thereby retained. The housing 11 is fixed on the internal side wall 92W in a state that an opening edge of the through hole 92V on the previously described internal side wall 92W is held between the retaining sleeve 28 and the flange 16F of the tip cylindrical portion 16. The tip cylindrical portion 16 is in such a state that only the tip portion thereof protrudes from the tip face of the retaining sleeve 28.

In addition, a notch (not illustrated) is formed at two sites of the opening edge of the through hole 92V. The housing 11 is turned, with the engagement protrusion portions 16A, 16A being inserted into the notches, by which the engagement protrusion portions 16A, 16A are locked at the opening edge of the through hole 92V. Further, the engagement warping pieces 16B, 16B come slidingly in contact with the opening edge of the through hole 92V, and are warped, then, returned elastically and locked at the opening edge of the through hole 92V. Still further, a packing 29 is held between the retaining sleeve 28 and the opening edge of the through hole 92V.

As shown in FIG. 6, a gear supporting shaft 18 (corresponding to the "rotational movement center shaft" of the present invention) protrudes from an inner face of the lower main plate portion 13B. The gear supporting shaft 18 is formed independently from the main plate portion 13 and assumes a solid cylindrical structure as a whole, excluding a tip portion thereof, and the tip portion is structured in such a manner that the cylindrical body is vertically divided into a plurality of warping pieces 18B. A tip engagement protrusion portion 18A is provided at a tip outer face of each of the warping pieces 18B. Further, each of the tip engagement protrusion portions 18A is gradually increased in amount of protrusion from the outer face of the warping piece 18B, with closer distance to the base end of the warping piece 18B.

Figure 10:
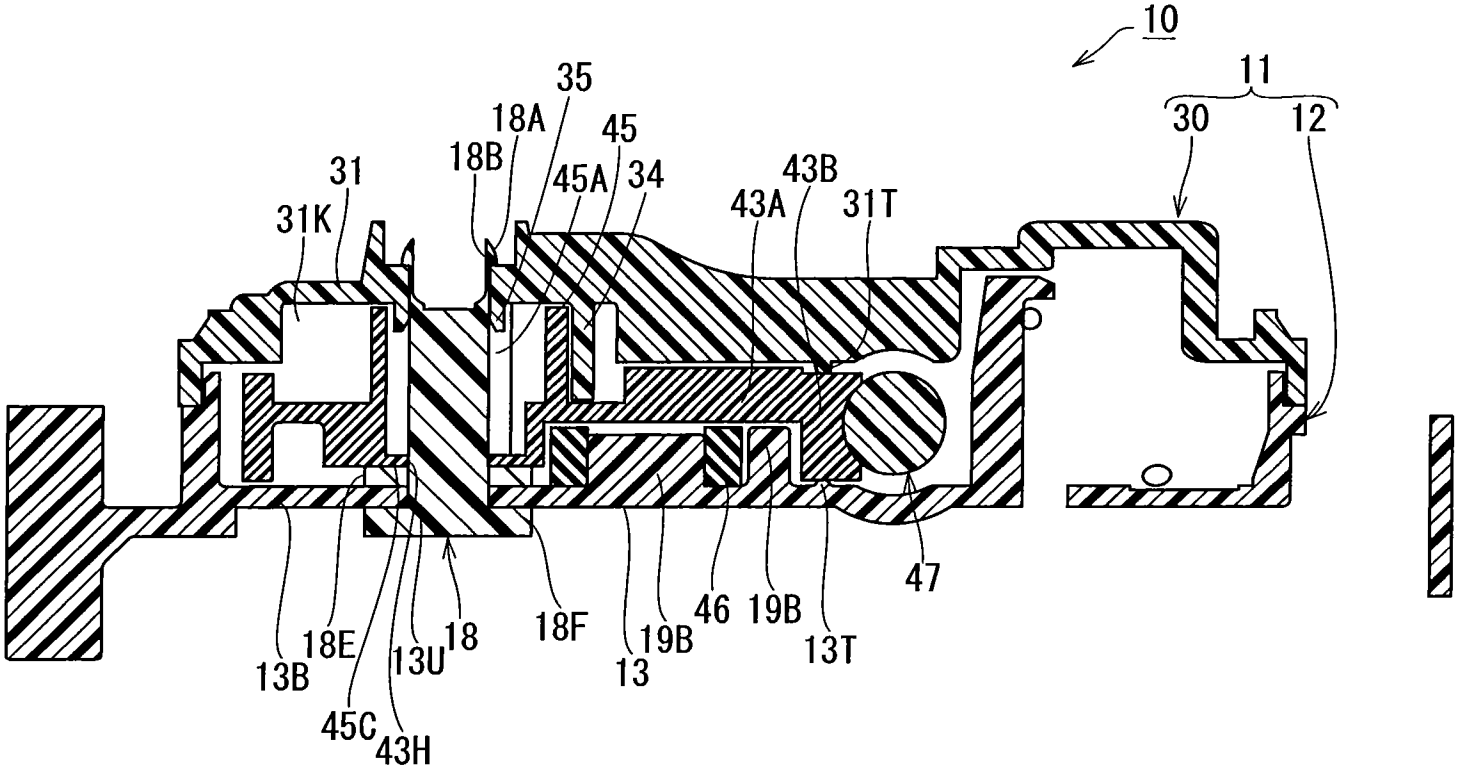
FIG. 10 is a planar cross-sectional view which is taken along the line B-B in FIG. 8.

A flange 18F (refer to FIG. 5) swells out laterally from a base end portion of the gear supporting shaft 18. As shown in FIG. 10, the gear supporting shaft 18 is inserted from outside into a through hole 13U which is formed close to the rear end of the upper end edge of the lower main plate portion 13B. An E ring 18E is press-fitted from the tip and the lower main plate portion 13B is in a state of being held between the flange 18F and the E ring 18E. The gear supporting shaft 18 is fixed to the lower main plate portion 13B.

As shown in FIG. 5, a circular depressed portion 31K is formed co-axially with the gear supporting shaft 18 (refer to FIG. 6) on the sub-housing 30. The circular depressed portion 31K is formed by depressing a part of the inner face of the sub-plate portion 31 in a circular shape, and a shaft supporting hole 35A passes through the center of an innermost face of the circular depressed portion 31K. The tip portion of the gear supporting shaft 18 is pressed into the shaft supporting hole 35A, while warping the warping piece 18B. As shown in FIG. 10, a group of the tip engagement protrusion portions 18A is locked from outside at the opening edge of the shaft supporting hole 35A.

In addition, as shown in FIG. 5, a center protrusion portion 35 protrudes toward the main housing 12 from the opening edge of the shaft supporting hole 35A. Further, a circular-arc protrusion piece 34 which is curbed at the center of the shaft supporting hole 35A protrudes from a part forward from the shaft supporting hole 35A on the innermost face of the circular depressed portion 31K.

As shown in FIG. 8, a worm wheel 43 to be described later in detail (corresponding to the "rotational movement transmitting component" of the present invention) is rotatably installed on the gear supporting shaft 18. Further, the gear cover curved portion 14W of the previously described main side wall 14 is given as a circular arc around the gear supporting shaft 18 and slightly greater in diameter than the worm wheel 43.

As shown in FIG. 6, a slide contact circular arc protruding strip 13T which is formed in a circular arc-shape around the gear supporting shaft 18 is formed on the inner face of the lower main plate portion 13B. The slide contact circular arc protruding strip 13T is also extendedly formed at a position close to the rear end of the vertical partition wall 17. Further, as shown in FIG. 5, a slide contact circular-arc protruding strip 31T similar to the slide contact circular arc protruding strip 13T is formed around the shaft supporting hole 35A on the inner face of the sub-plate portion 31 as well. The worm wheel 43 to be described later rotates, while sliding contacting with the slide contact circular arc protruding strips 13T, 31T.

A first and a second rotational movement regulating protrusions 19A, 19B are provided at an inner part of the slide contact circular arc protruding strip 13T at the front of the gear supporting shaft 18 in the upper edge portion of the lower main plate portion 13B. The first rotational movement regulating protrusion 19A is disposed at the front of the gear supporting shaft 18, the cross sectional shape of which assumes a rectangular shape extending in the front-back direction along an edge of the guide groove portion 15. On the other hand, the second rotational movement regulating protrusion 19B is disposed at the front of the first rotational movement regulating protrusion 19A, the cross sectional shape of which assumes a shape in which rectangular both ends extending downward from an edge of the guide groove portion 15 are rounded into a circular-arc shape.

Figure 11:
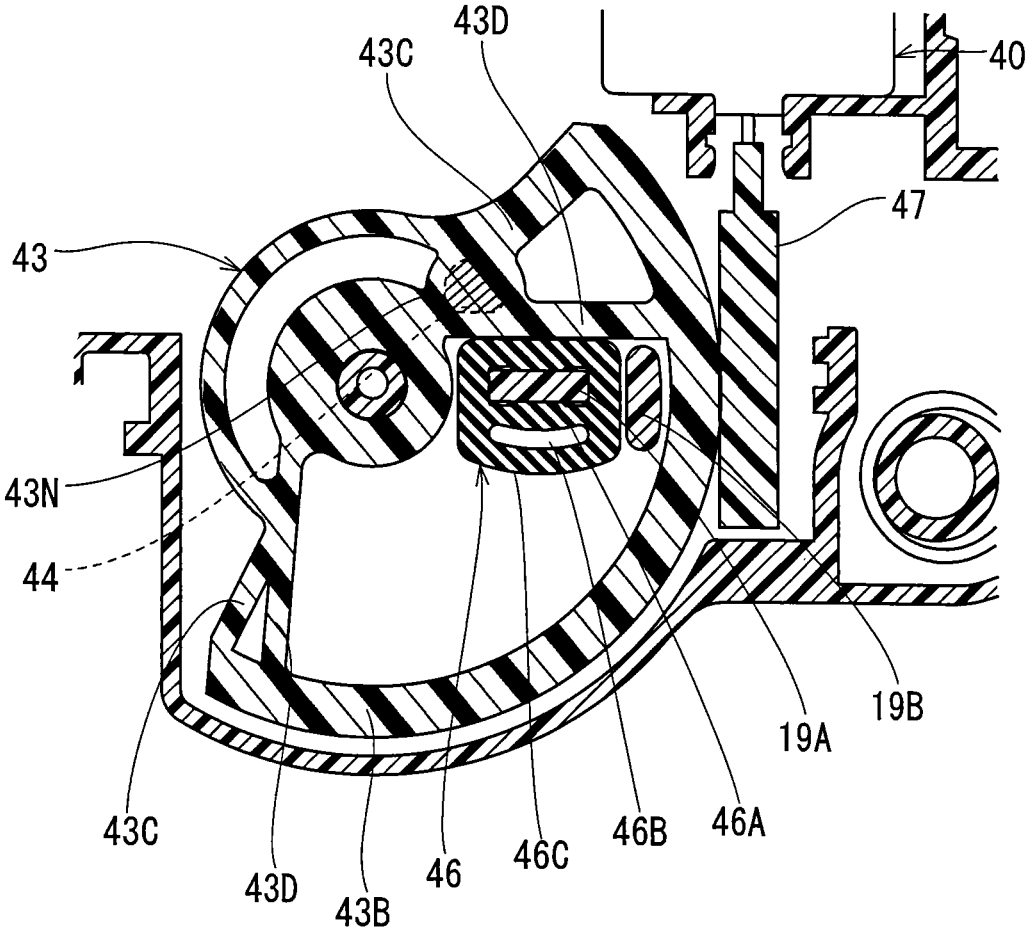
FIG. 11 is a lateral cross-sectional view of the lid locking device in a state that a worm wheel is disposed at a forward rotation limit position.

As shown in FIG. 11, a cushion rubber 46 is installed on the first rotational movement regulating protrusion 19A. As shown in FIG. 6, the cushion rubber 46 is structured in such a manner that one side face of a rubber piece having a substantially rectangular outer edge shape is given as a curved side face 46C side which is curved so as to swell outside, and an installation hole 46A and a buffer hole 46B are arrayed between the curved side face 46C and a side face on the opposite side thereof. Further, the buffer hole 46B is disposed on the curved side face 46C and formed in a long hole shape which is curved in parallel with the curved side face 46C. On the other hand, the installation hole 46A is formed in a long hole shape which extends in parallel with a side face on the opposite side of the curved side face 460 and both ends thereof in the longitudinal direction are made slightly wider. As shown in FIG. 11, the first rotational movement regulating protrusion 19A is fitted into the installation hole 46A, and the buffer hole 46B is disposed on a side away from the guide groove portion 15 in relation to the installation hole 46A. Further, the second rotational movement regulating protrusion 19B is adjacent by way of a slight clearance to one side face which is laterally next to the curved side face 46C of the cushion rubber 46.

As shown in FIG. 6, a step portion 13D is provided at a middle point of the lower main plate portion 13B in the front-back direction, and a front part from the step portion 13D of the lower main plate portion 13B is shifted to the sub-plate portion 31, as compared with a rear part thereof. A reinforcing wall 20 protrudes from a part forward from the step portion 13D on the inner face of the lower main plate portion 13B. The reinforcing wall 20 is formed in a plate shape which extends vertically to partition the main plate portion 13 into the front and the rear. Further, the guide groove portion 15 of the reinforcing wall 20 protrudes greatly from the lower main plate portion 13B in relation to the main side wall 14 and is given as a reinforcing main portion 20A. A pair of ribs 20L, 20L are formed on a rear face of the reinforcing main portion 20A, and a locking protrusion 20K protrudes forward from the tip on the front face of the reinforcing main portion 20A.

A cylindrical column 25 protrudes from a part forward from the reinforcing wall 20 in the lower main plate portion 13B. The cylindrical column 25 is equal in height to the reinforcing main portion 20A. The main housing 12 is integrated with the sub-housing 30, by which the tip portion of the reinforcing wall 20 is fitted into a first front end recessed portion 37A (refer to FIG. 5) formed on the inner face of the sub-housing 30, and the tip portion of the cylindrical column 25 is also fitted into a second front end recessed portion 37B (refer to FIG. 5) formed on the inner face of the sub-housing 30. Further, a through hole 25A inside the cylindrical column 25 passes through the housing 11 in a lateral direction by way of a through hole 37C (refer to FIG. 4) which is formed at the center of the second front end recessed portion 37B, and the lid locking device 10 is fixed to the vehicle 90 by a bolt inserted therethrough.

As shown in FIG. 7, a locking member 50 is linearly movably accommodated at the guide groove portion 15. As shown in FIG. 6, the locking member 50 is provided with a first to a sixth rod constituting portion 57 to 62 arrayed sequentially so as to extend in the front-back direction from the front end to the rear end.

Figure 9:
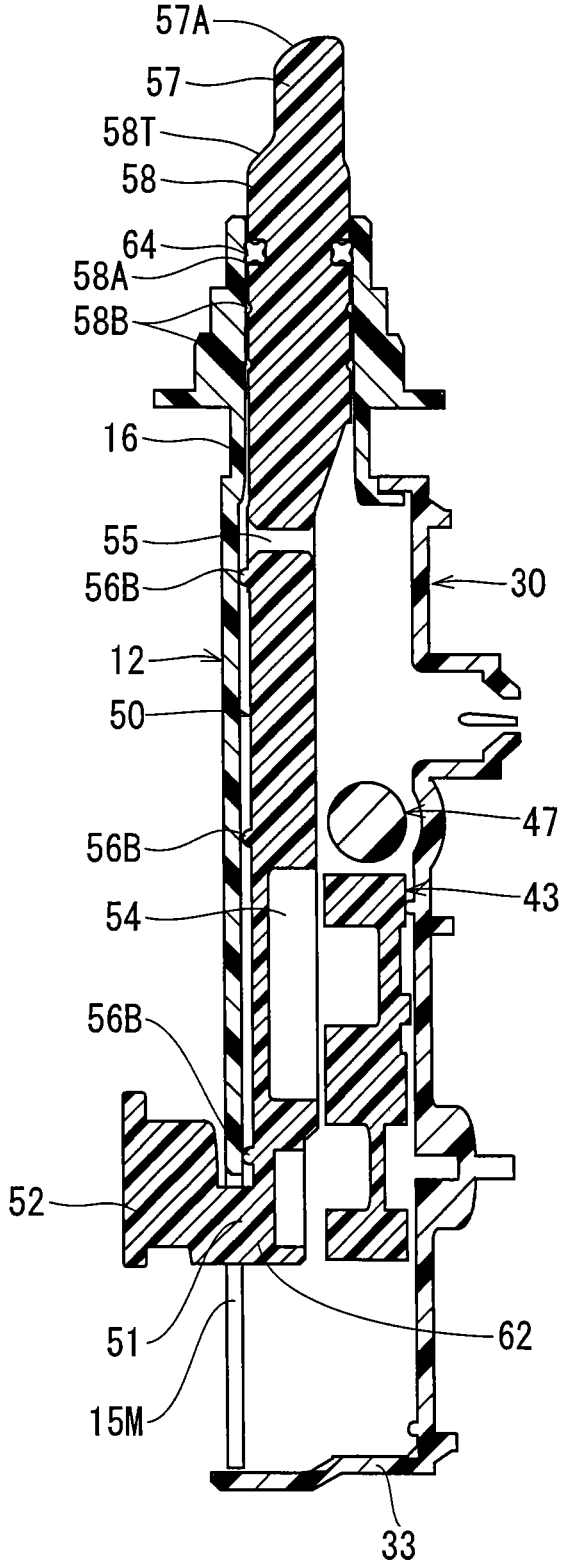
FIG. 9 is a planar cross-sectional view which is taken along the line A-A in FIG. 8.

The second rod constituting portion 58 is formed to have a circular cross section and extends in the front-back direction, with an outer diameter thereof made slightly smaller than an inner diameter of the tip cylindrical portion 16. Further, as shown in FIG. 9, a seal ring groove 58A is formed at a position close to the front end on an outer face of the second rod constituting portion 58, and a pair of annular grooves 58B, 58B are formed in the rear thereof. A seal ring 64 is installed on the seal ring groove 58A. In addition, as shown in FIG. 6, an inclined face 58C inclined rearward is formed on the opposite side of the groove bottom wall 15S (on the sub-plate portion 31 side) at the rear end portion of the second rod constituting portion 58 so as to come closer toward the center of the second rod constituting portion 58.

Figure 13:
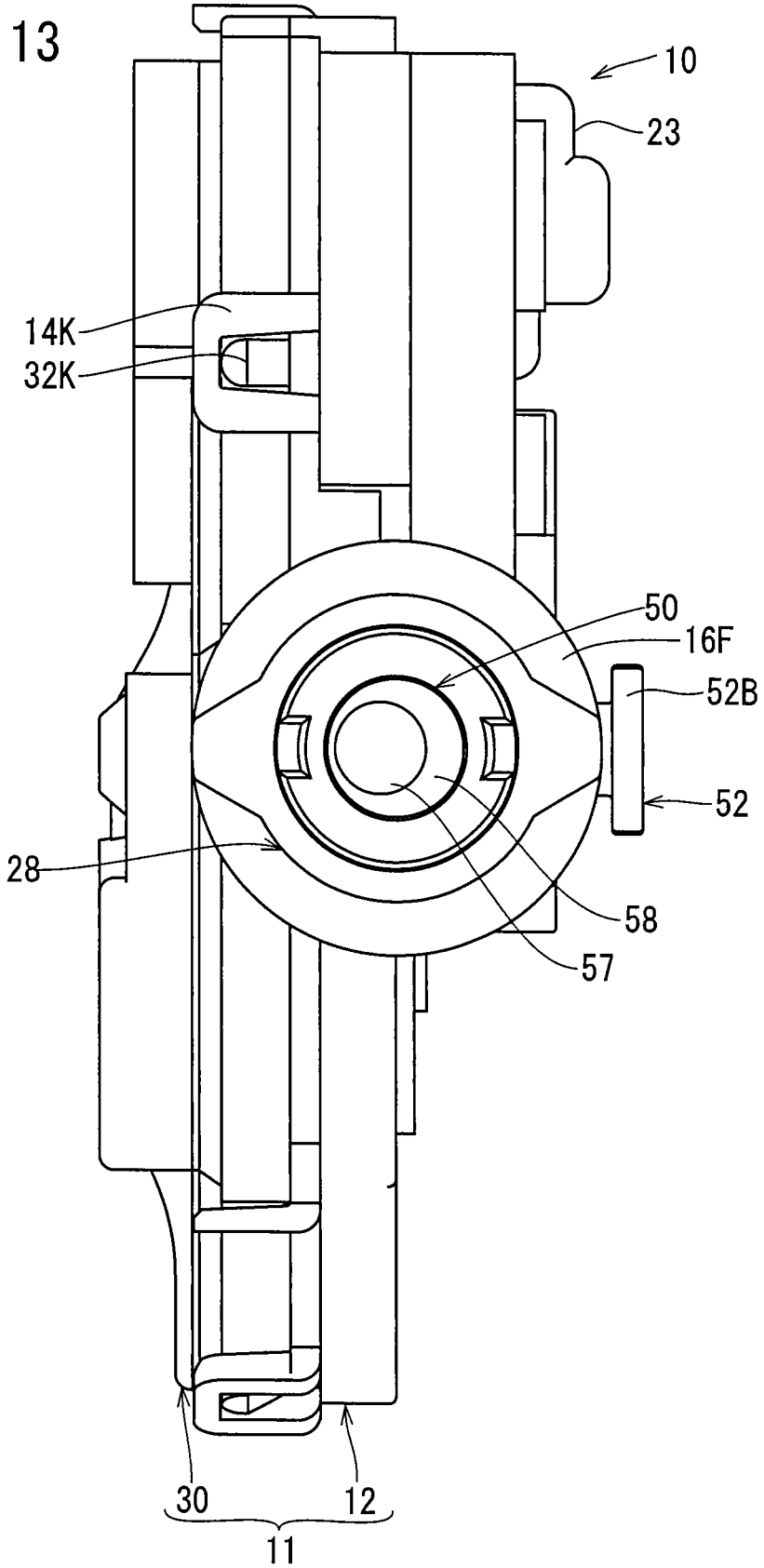
FIG. 13 is a front view of the lid locking device.
Figure 16A:
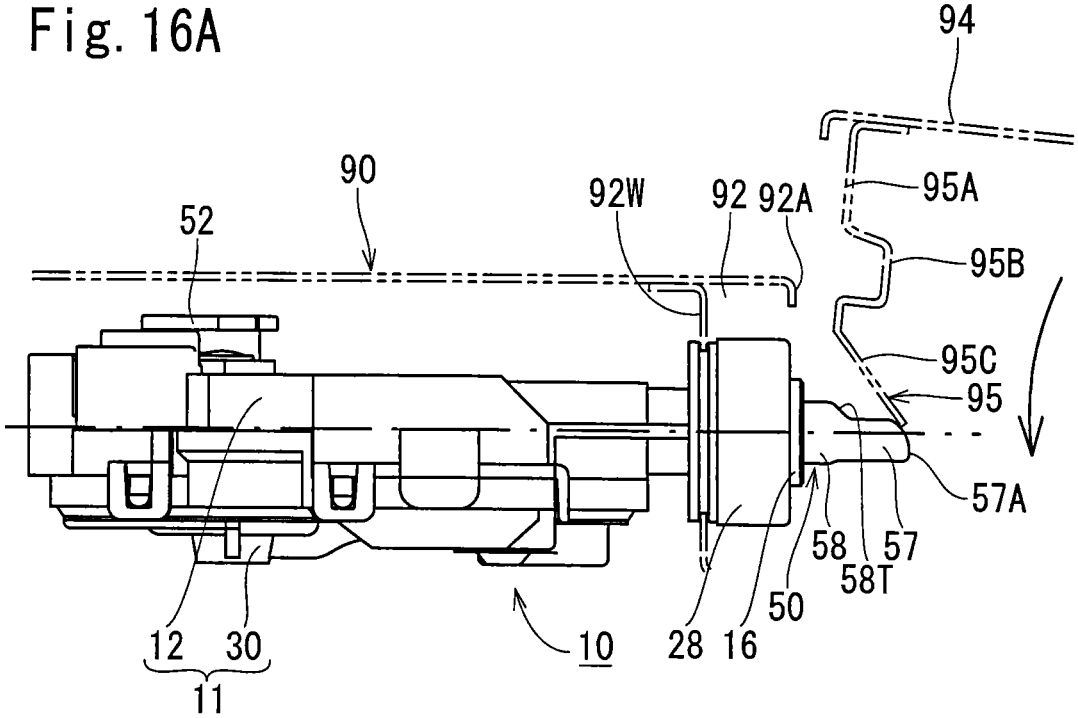
FIG. 16A is a plan view which shows the lid locking device in a state that the locking member is disposed at the origin position.

The first rod constituting portion 57 is formed so as to have a circular cross section smaller in diameter than the second rod constituting portion 58 (for example, a circular cross section, the diameter of which is about half the second rod constituting portions 58), extending in the front-back direction. The first rod constituting portion 57 is shorter in length than the second rod constituting portion 58. Further, as shown in FIG. 5, the central axis of the first rod constituting portion 57 is shifted in relation to the central axis of the second rod constituting portions 58. More specifically, as shown in FIG. 13, in the vertical direction, the central axis of the first rod constituting portion 57 is disposed at the same position as the central axis of the second rod constituting portion 58. As shown in FIG. 16A, in the transverse direction, the central axis of the first rod constituting portion 57 is disposed so as to be shifted away from the lid 94 in relation to the central axis of the second rod constituting portion 58. Further, as shown in FIG. 9, the tip portion of the second rod constituting portion 58 is given as a rounded diameter-reducing portion 58T, and the diameter reducing portion 58T is formed in a closed ring shape which surrounds an entire base end portion of the first rod constituting portion 57. Still further, the tip face of the first rod constituting portions 57 is given as a tip swelling face 57A which inclines in the transverse direction so as to face obliquely to the front of the lid 94 and also swells out. More specifically, as shown in FIG. 2, the tip swelling face 57A is inclined in an angular range of 30 to 45 degrees, with the lid 94 lowered backward in relation to an imaginary reference face K1 which is orthogonal to an axial direction of the first rod constituting portion 57. The tip swelling face 57A swells outside as a whole and is rounded.

As shown in FIG. 5, the fourth rod constituting portion 60 is structured so as to give a cylindrical column body which is substantially equal in outer diameter to the second rod constituting portion 58 and extends in the front-back direction in which the sub-plate portion 31 is flatly cut up to a position close to the central axis to form an intermediate flat face 50A (refer to FIG. 6). In addition, the fourth rod constituting portion 60 is also provided with a streak-like side flat face 60B (refer to FIG. 5) which is orthogonal to the intermediate flat face 50A by slightly cutting both sides of the intermediate flat face 50A. Further, a plurality of rectangular holes 60C (refer to FIG. 5) for weight saving are formed on a side opposite to the intermediate flat face 50A of the fourth rod constituting portion 60.

As shown in FIG. 5, the third rod constituting portion 59 is formed in a rectangular parallelepiped shape as a whole, and a rectangular cross section thereof has a dimension which includes a circular-arc shaped cross section of the fourth rod constituting portion 60. Further, as shown in FIG. 6, one side face of the third rod constituting portion 59 is given as an intermediate flat face 50A which is formed in continuation from the fourth rod constituting portion 60. The rear end portion of the inclined face 58C of the second rod constituting portion 58 is linked to the front end portion of the intermediate flat face 50A. Further, a long-hole shaped spring locking hole 55 extending in the vertical direction is formed so as to penetrate through the third rod constituting portion 59.

In addition, as shown in FIG. 5, a slidingly-contacting protruding strip 56B which extends in the vertical direction to have a semi-circular arc shaped cross section is formed on a side face on the groove bottom wall 15S side of the third rod constituting portion 59.

As shown in FIG. 6, the fifth rod constituting portion 61 is structured so as to have a receiving recessed portion 54 by cutting a part of a rectangular column which extends as a whole in the front-back direction. Further, one side face of the fifth rod constituting portion 61 is given as an intermediate flat face 50A which is formed in continuation from the third and the fourth rod constituting portion 59, 60.

The receiving recessed portion 54 is depressed from the intermediate flat face 50A in a stepwise manner and opened toward the side of the sub-plate portion 31 and below, extending in the front-back direction. Further, the inner side face of the rear end portion of the receiving recessed portion 54 is given as a pressurized face 54A which is orthogonal to the axial direction of the locking member 50. Still further, the inner side face of the receiving recessed portion 54 is formed in such a shape as to extend forward from the upper end portion of the pressurized face 54A, incline downward with movement forward on its way and bend further downward. A space at the front of the pressurized face 54A of the receiving recessed portion 54 is given as the interference avoiding space 54S (refer to FIG. 16B) of the present invention. In the present embodiment, the "power transmitting mechanism" of the present invention is composed of the interference avoiding space 54S and the pressurized face 54A as well as the worm gear 47, the worm wheel 43 and the pressurizing protrusion portion 44 to be described later.

In addition, a step face 61D is formed on a lower face of the fifth rod constituting portion 61 at a middle point in the front-back direction. A rear part from the step face 61D is increased downward. Further, the step face 61D is curved in a one-quarter circular-arc shape. Still further, a pair of slidingly-contacting protruding strips 56A, 56A are formed at a front position from the step face 61D on an upper face and a lower face of the fifth rod constituting portion 61. The upper slidingly-contacting protruding strip 56A extends in the transverse direction and assumes a semi-circular arc shape. On the other hand, the lower slidingly-contacting protruding strip 56A is formed so as to be symmetrical with respect to the upper slidingly-contacting protruding strip 56A and shorter than the upper slidingly-contacting protruding strip 56A. In addition, as shown in FIG. 5, a slidingly-contacting protruding strip 56B similar to the slidingly-contacting protruding strip 56B of the above-described third rod constituting portion 59 is formed at the front end portion of the fifth rod constituting portion 61 on a face facing to the groove bottom wall 15S.

As shown in FIG. 6, the sixth rod constituting portion 62 is formed as a whole in a rectangular parallelepiped shape which extends in the front-back direction. One side face thereof on the side of the sub-plate portion 31 is made lower than the intermediate flat face 50A in a stepwise manner and provided with a rectangular hole 62A for weight saving. Further, a switch contact portion 53 protrudes from an upper face of the sixth rod constituting portion 62. As shown in FIG. 7, the switch contact portion 53 protrudes upward from the vertical partition wall 17 and is dimensionally large enough to pass through the rod passing port 14A in the front-back direction. Still further, a front face of the switch contact portion 53 is given as a contacting front face 53A which is orthogonal to the axial direction of the locking member 50. In addition, the above-described slidingly-contacting protruding strip 56A is provided on the lower face of the sixth rod constituting portion 62. In addition, as shown in FIG. 5, on a side face of the groove bottom wall 15S side of the sixth rod constituting portion 62, the above-described slidingly-contacting protruding strip 56B is formed from an upper end of the switch contact portion 53 to a lower end portion of the sixth rod constituting portion 62 at the front end portion thereof.

Figure 14:
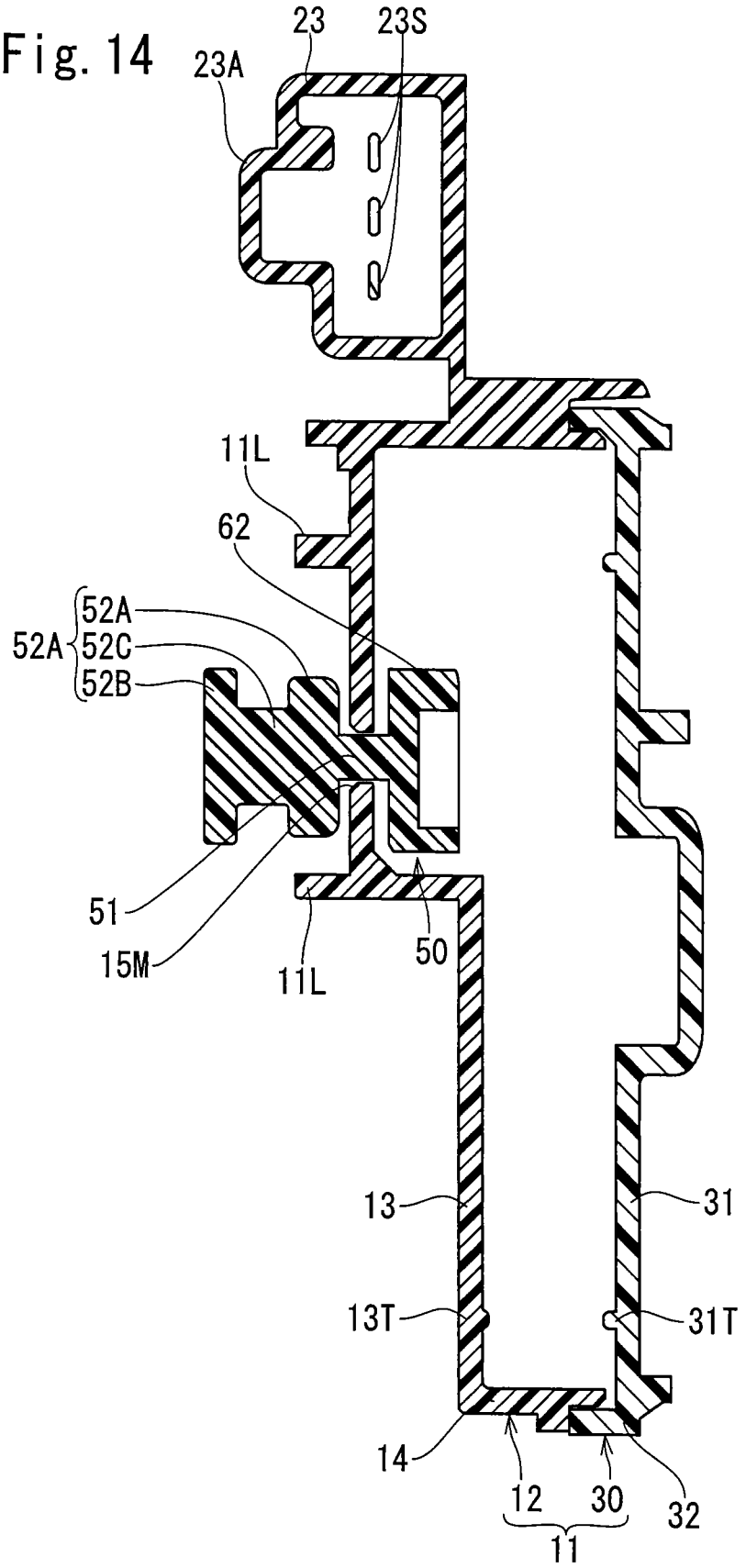
FIG. 14 is a rear cross-sectional view of a housing and a locking member.

A slit through rib 51 protrudes from the side face of the sixth rod constituting portion 62 on the groove bottom wall 15S side. As shown in FIG. 9 and FIG. 14, the slit through rib 51 is disposed so as to be close to the rear end of the sixth rod constituting portion 62 at the center in the vertical direction and penetrates through the guide slit 15M.

As shown in FIG. 6, a side head portion 52 is provided at the tip of the slit through rib 51. The side head portion 52 is composed of a slide plate 52A, a relay column 52C and an operation head 52B. The slide plate 52A is formed substantially in a rectangular plate shape opposite to the sixth rod constituting portion 62 as a whole behind the slit through rib 51. A face of the slide plate 52A which opposes to the sixth rod constituting portion 62 is curved in such a manner as to come closer to the sixth rod constituting portion 62 toward the center in the front-back direction. Further, a face of the slide plate 52A on the opposite side of the sixth rod constituting portion 62 is bent in an angular shape in such a manner as to come closer to the operation head 52B toward the center in the front-back direction. Still further, the operation head 52B is formed in an oval shaped plate in which both front-and-rear end portions are curved in a circular-arc shape. In addition, the relay column 52C assumes a flat columnar shape which relays between the slide plate 52A and the operation head 52B, and the cross sectional shape thereof is formed in an oval shape which is one-size smaller than the operation head 52B.

In addition, as shown in FIG. 2, a wire W is installed on the relay column 52C and a terminal portion of the wire W is drawn out into a trunk room 96 of the vehicle 90 (refer to FIG. 1).

Figure 15A:
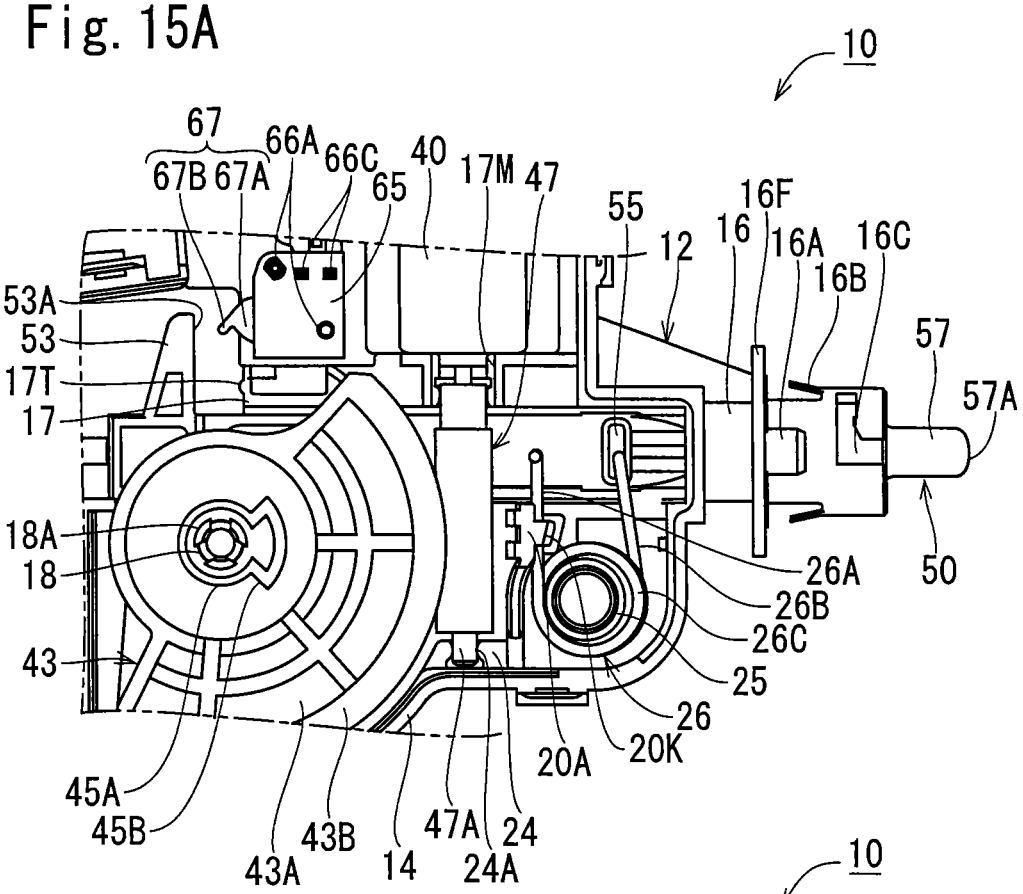
FIG. 15A is an internal side view which shows the lid locking device in a state that the locking member is disposed at a locking position and the worm wheel is disposed at the forward rotation limit position.
Figure 15B:
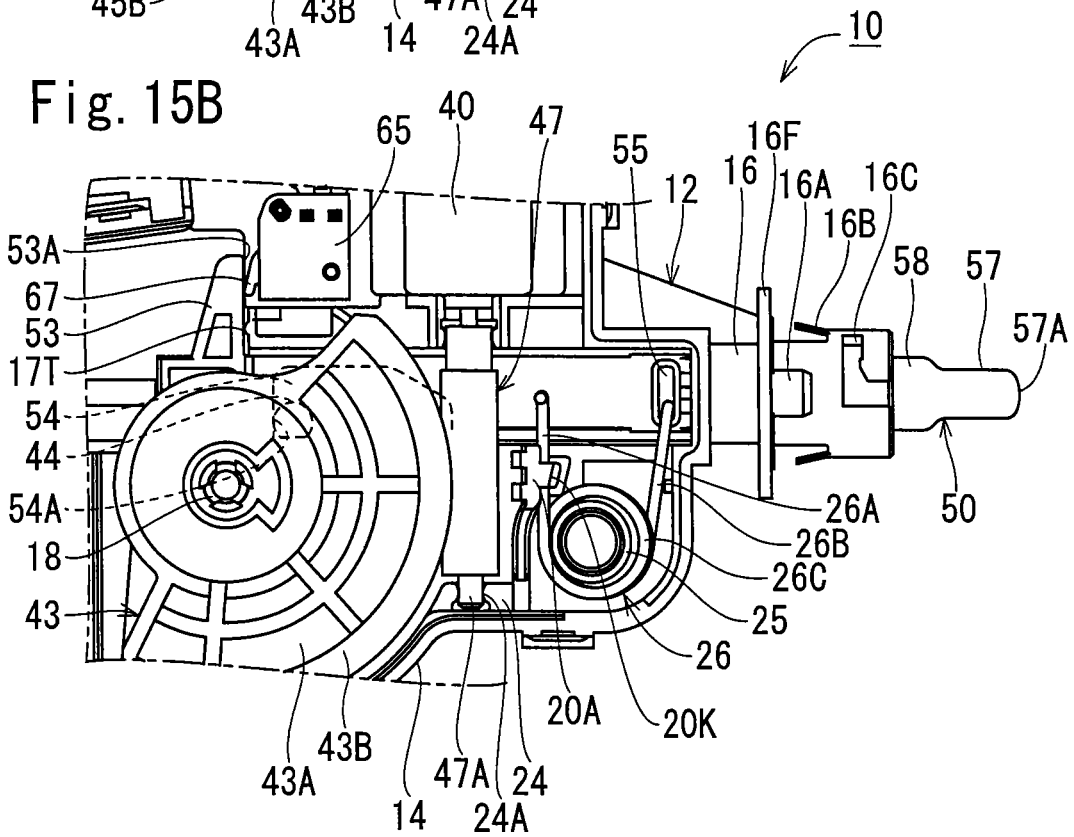
FIG. 15B is an internal side view which shows the lid locking device in a state that the locking member is disposed at an origin position and the worm wheel is disposed at the forward rotation limit position.

The locking member 50 is urged forward by a torsion coil spring 26 shown in FIG. 5 (corresponding to the "urging spring" of the present invention). The torsion coil spring 26 is structured in such a manner that tips of a pair of terminal arm portions 26A, 26B jutting out from both ends of a coil portion 26C are bent at a right angle in mutually opposing directions. As shown in FIG. 15B, the coil portion 26C is inserted outside the cylindrical column 25, and one of the terminal arm portions 26A is pressed toward the base end side with respect to the locking protrusion 20K on a front face of the reinforcing main portion 20A, and a tip portion of the other of the terminal arm portions 26B is assembled so as to be inserted into the spring locking hole 55 of the locking member 50.

Figure 16B:
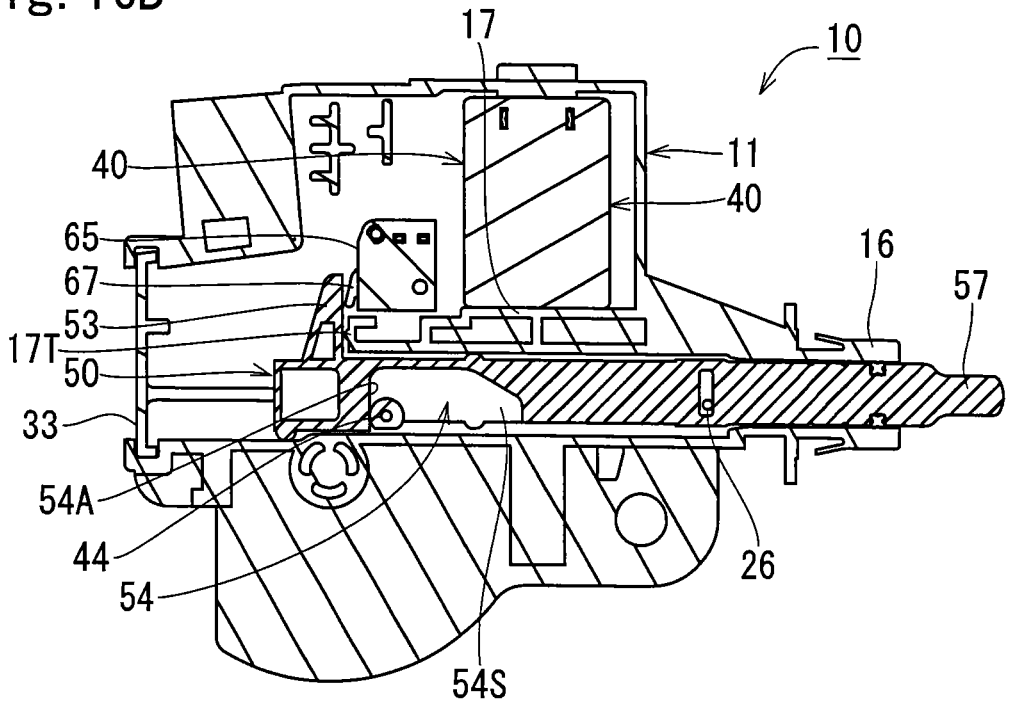
FIG. 16B is a lateral cross-sectional view which shows the lid locking device in a state that the locking member is disposed at the origin position and the worm wheel is disposed at the forward rotation limit position.

When the lid 94 is open as shown in FIG. 16A, the locking member 50 moves, as shown in FIG. 16B, only by elastic force of the torsion coil spring 26 to the origin position at which the contacting front face 53A of the switch contact portion 53 is in contact with the contacting protruding strip 17T at the rear end of the vertical partition wall 17. Further, as shown in FIG. 15B, the front end portion of the locking member 50 disposed at the origin position is in a state of protruding forward from the tip cylindrical portion 16. When the lid 94 is closed, the tip guide portion 95C of the engagement protrusion piece 95 provided on the lid 94 presses the tip swelling face 57A at the front end of the first rod constituting portion 57 of the locking member 50 to slide contact with the tip swelling face 57A. When the locking member 50 is pressed backward to move backward to the unlocked position shown in FIG. 17B, the first rod constituting portion 57 of the locking member 50 passes through the tip guide portion 95C and rides over a position which is close to the tip guide portion 95C side with respect to the engagement recessed portion 95B at the rod abutting portion 95A.

Figure 17A:
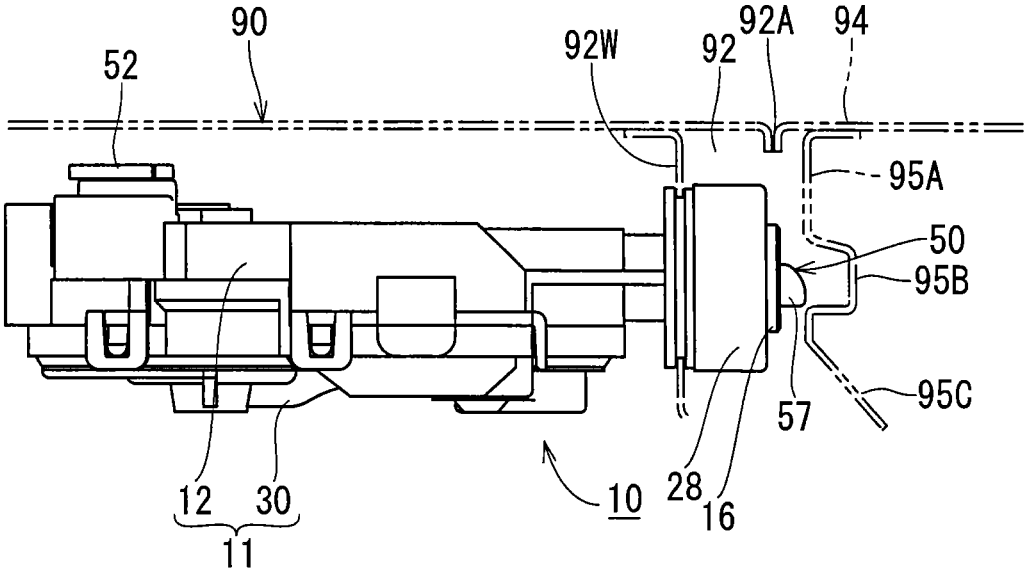
FIG. 17A is a plan view which shows the lid locking device in a state that the locking member is disposed at an unlocked position.
Figure 17B:
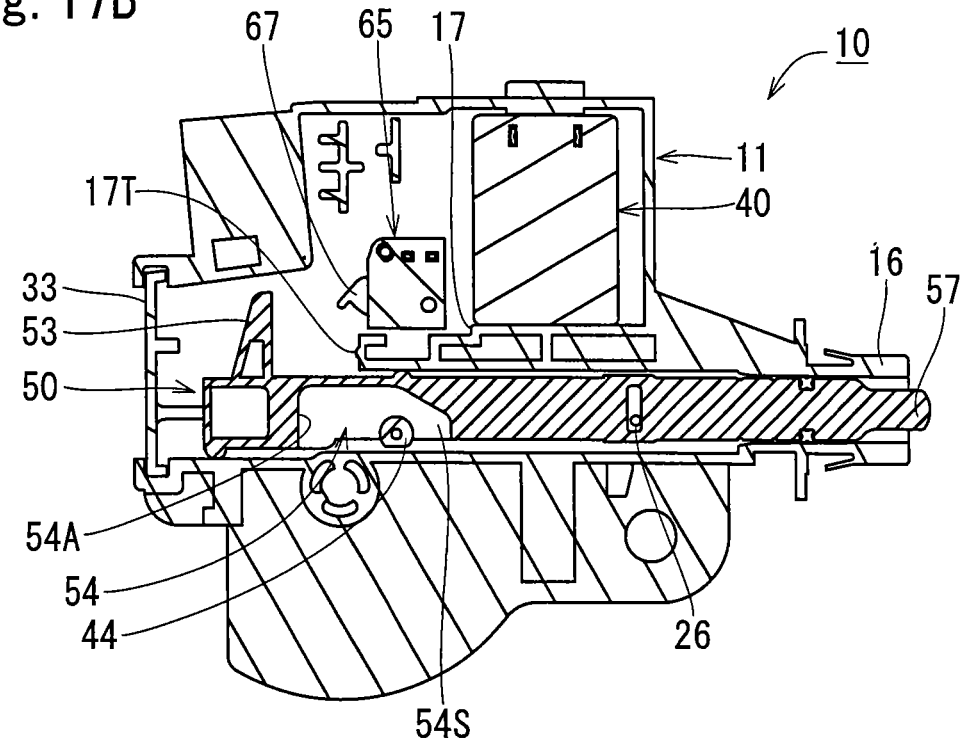
FIG. 17B is a lateral cross-sectional view which shows the lid locking device in a state that the locking member is disposed at the unlocked position and the worm wheel is disposed at the forward rotation limit position.
Figure 18A:
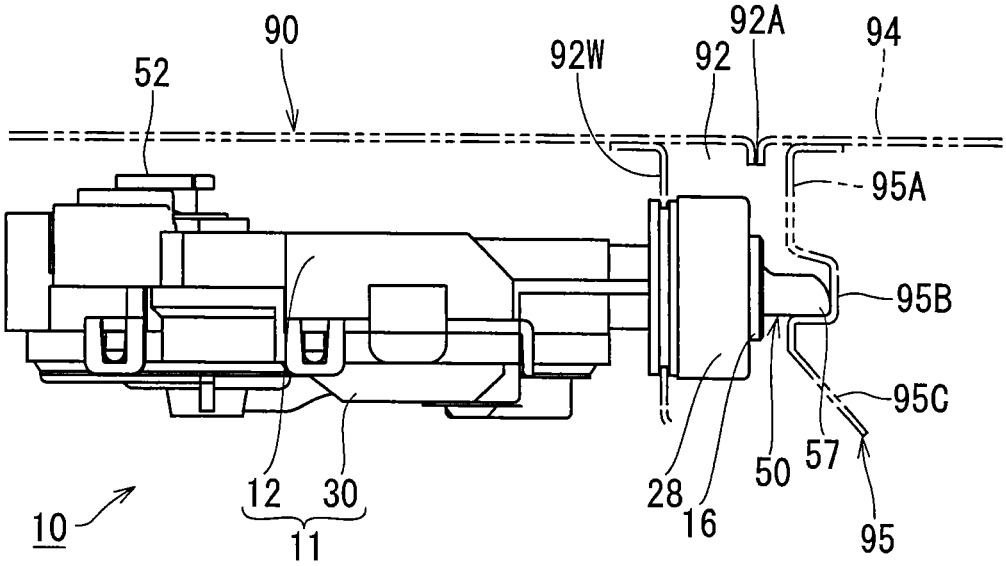
FIG. 18A is a plan view which shows the lid locking device in a state that the locking member is disposed at a locking position.
Figure 18B:
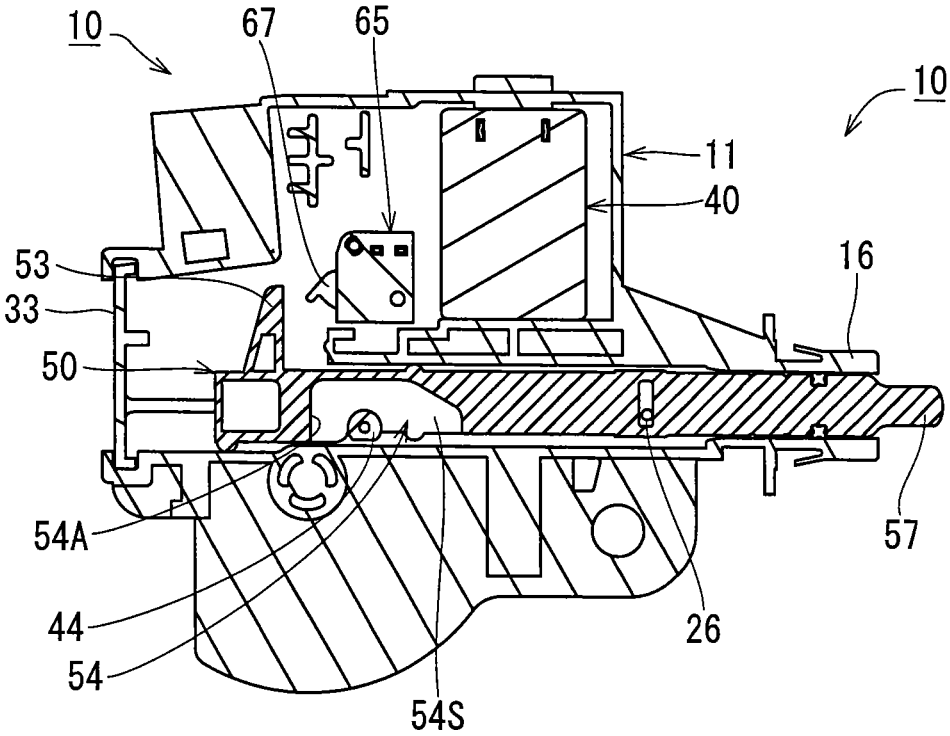
FIG. 18B is a lateral cross-sectional view which shows the lid locking device in a state that the locking member is disposed at the locking position and the worm wheel is disposed at the forward rotation limit position.

In a totally closed state in which the lid 94 is completely closed as shown in FIG. 17A, the first rod constituting portion 57 opposes to the engagement recessed portion 95B, and the locking member 50 moves forward by the elastic force of the torsion coil spring 26, thereby the first rod constituting portion 57 goes into the engagement recessed portion 95B. As shown in FIG. 18A, the tip of the first rod constituting portion 57 comes into contact with a innermost face of the engagement recessed portion 95B. Accordingly, as shown in FIG. 18B, the locking member 50 is positioned at the intermediate locking position between the origin position and the unlocked position.

In addition, a rear part from a front position at which the first rod constituting portion 57 of the locking member 50 goes into the engagement recessed portion 95B is entirely the unlocked position. Further, the side head portion 52 is operated to draw the locking member 50 backward, by which the locking member 50 arrives at a rear-end limit position at the rear end of the unlocked position (a position at which the locking member 50 shown in FIG. 7 moves further to the left side of the drawing and come in contact with the closing portion 33).

A detection switch 65 is assembled on the upper main plate portion 13A in order to monitor an open/close status of the lid 94 on the basis of linear motions of the locking member 50. As shown in FIG. 6, the detection switch 65 is provided with a rectangular parallelepiped switch body 66 which is flat in the transverse direction and structured so that a sensor 67 protrudes from a rectangular hole 66B on a rear face of the switch body 66. The sensor 67 rotates between an off position and an on position about a rotationally moving shaft which passes in the transverse direction through the vicinity of the upper end portion of the rectangular hole 66B of the switch body 66. Further, the sensor 67 is integrally provided with a fan-shaped portion 67A which droops perpendicularly from the rotationally moving shaft to swell outside from the rectangular hole 66B and a contacting piece 67B which is provided on a lower extension line of an inclined side face of the fan-shaped portion 67A. The sensor 67 is urged outside the rectangular hole 66B by an elastic member (not illustrated) and normally disposed at the off position shown in FIG. 7.

As shown in FIG. 6, a pair of bus bar connection holes 66C, 66C and a pair of mounting holes 66A, 66A penetrate through the switch body 66 in the transverse direction. The pair of bus bar connection holes 66C, 66C are arrayed back and forth at a position close to the upper end of the switch body 66. A second and a third bus bar 68Y, 68Z to be described later are inserted and connected to the bus bar connection holes 66C, 66C.

On the other hand, the pair of mounting holes 66A, 66A are disposed near a pair of opposing corners of the switch body 66. One of the mounting holes 66A is a round hole, while the other of the mounting holes 66A is formed in a long-hole shape extending in a direction in which the pair of mounting holes 66A, 66A are arrayed. The switch body 66 is installed on the main plate portion 13 in a state that a pair of sensor installation supports 21, 21 protruding from the inner face of the upper main plate portion 13A are fitted into the pair of mounting holes 66A, 66A. Further, as shown in FIG. 15A, a lower face of the switch body 66 is adjacent to an upper face of the vertical partition wall 17, and a rear face of the switch body 66 is disposed at a position which is slightly shifted forward from a rear end face of the vertical partition wall 17. Still further, the sensor 67 protrudes backward from the contacting protruding strip 17T in a state of being at the off position. As shown in FIG. 15B, when the locking member 50 is disposed at the origin position, the switch contact portion 53 presses the sensor 67 forward up to the on position, by which the detection switch 65 is turned on. In addition, when the locking member 50 moves away from the origin position to the locking position or the unlocked position, the switch contact portion 53 moves away from the sensor 67, and the sensor 67 returns to the off position elastically, by which the detection switch 65 is turned off.

As shown in FIG. 8, a first to a third bus bar 68X, 68Y, 68Z are laid sequentially from above, with an interval kept, on an inner face of the upper main plate portion 13A. More specifically, the rear end portion of each of the first to the third bus bar 68X, 68Y, 68Z extends in the front-back direction and is also arrayed in parallel, passing through the bus bar insertion slit 23S on the main side wall 14, thereby forming a male terminal fitting (what is called tongue piece) which protrudes from a innermost face inside the male connector hood 23.

Further, the third bus bar 68Z is formed in such a shape to extend forward and then be bent downward inside the interior of the main side wall 14. A connection piece (not illustrated) is curved in a rising manner from the lower end portion thereof, inserted and connected to the bus bar connection hole 66C of the switch body 66 which is close to the rear side thereof. Still further, the first and the second bus bar 68X, 68Y are both extended forward inside the main side wall 14 and bent so as to swell downward. The front part thereof extends upward in parallel.

Connection pieces 68T, 68T shown in FIG. 5 are bent in a rising manner from a side edge portion at the upper end portion of each of the first and the second bus bar 68X, 68Y, inserted and connected to bus bar connection holes 41, 41 of a motor 40 to be described later (corresponding to the "drive source" of the present invention). Further, a branching piece 68J extends so as to get into a space between the switch body 66 and the upper main plate portion 13A from a middle portion of the second bus bar 68Y. A connection piece (not illustrated) obtained by bending in a rising manner the tip of the branching piece 68J is inserted and connected to the bus bar connection hole 66C of the switch body 66 which is on the front side. The sensor 67 is disposed at the on position, by which electricity is conducted between the second and the third bus bar 68Y, 68Z. On the other hand, the sensor 67 is disposed at the off position, by which electricity is cut off between the second and the third bus bar 68Y, 68Z.

As shown in FIG. 6, a partition wall 13X which separates the first bus bar 67X from the second bus bar 68Y and a partition wall 13Y which separates the second bus bar 68Y from the the third bus bar 68Z protrude on the inner face of the upper main plate portion 13A. Further, a positioning hole 68A is formed at each of the first to the third bus bar 68X, 68Y, 68Z. A plurality of bus bar positioning protrusions 22 which protrude from the inner face of the upper main plate portion 13A are fitted into the positioning holes 68A.

In addition, the first to the third bus bar 68X, 68Y, 68Z are assembled on the main housing 12, together with the detection switch 65 in a state that they are integrated by a bridging wall 68K and also the second and the third bus bar 68Y, 68Z are connected to the detection switch 65. The motor 40 to be described later is assembled on the main housing 12, and the bridging wall 68K is removed after the first and second bus bar 68X, 68Y are connected to the motor 40.

The motor 40 is assembled on the housing 11 as a drive source allowing the locking member 50 to move backward, and power of the motor 40 is transmitted by way of the worm gear 47 and the worm wheel 43 to the locking member 50. More specifically, the motor 40 is assembled to the front of the detection switch 65 of the main housing 12 in a state that the rotating shaft is oriented in the vertical direction. Further, an output rotating shaft 40S (refer to FIG. 7) protrudes from the center of the lower end face of the motor 40, to which the worm gear 47 is fixed so as to rotate in an integral manner. Further, as shown in FIG. 5, a pair of parallel flat faces are provided on a lateral part of the motor 40, and connection pieces 68T, 68T of the above-described first and the second bus bar 68X, 68Y are inserted and connected to the pair of bus bar connection holes 41, 41 provided on an upper end side of one of the flat faces. Still further, a back face protrusion portion 40T protrudes from the center of the base end face of the motor 40 and is received by motor positioning recessed portions 14M, 32M which are formed on the respective inner faces of the main side wall 14 and the sub-side wall 32. In addition, as shown in FIG. 7, a front protrusion portion 40U protrudes from a periphery of the output rotating shaft 40S on the tip face of the motor 40 and is received by the motor positioning groove 17M which is formed on the vertical partition wall 17.

The worm gear 47 extends downward from the motor positioning groove 17M comes across the guide groove portion 15, and is butted against the inner face of the lower main plate portion 13B adjacently behind the reinforcing wall 20. Further, adjacently behind the reinforcing wall 20 of the lower main plate portion 13B, a pair of worm holding portions 24, 24 are arrayed back and forth along the inner face of the main side wall 14. A center shaft 47A which protrudes from the center of the tip face of the worm gear 47 is held between the pair of worm holding portions 24, 24 and regulated for forward and backward movement. In addition, circular-arc protrusion portions 24A, 24A having a semi-circular cross section protrude from opposing faces of the worm holding portion 24,24 so as to move close to each other. These circular arc protrusion portions 24A, 24A are in point contact with the center shaft 47A.

As shown in FIG. 6, the worm wheel 43 is provided with a turning plate 43F formed by extending a fan-shaped plate portion 43A from a circular plate portion 43E. Further, a reinforcing rib 43L slightly protrudes on front-back both sides of the fan-shaped plate portion 43A.

A main circular-arc side wall 43B which is formed by curving a band plate in a circular-arc shape continues to a circular-arc portion of an outer edge of the fan-shaped plate portion 43A, and a gear portion 43G is formed on an outer circumferential face of the main circular-arc side wall 43B. Further, a sub-circular arc side wall 43M which is formed by curving a band plate in a circular-arc shape so as to be smaller than the main circular-arc side wall 43B continues to a circular-arc portion of an outer edge of a circular plate portion 43E. Still further, connecting side walls 43C, 43C extending so as to connect between one ends of the sub-circular arc side wall 43M and the main circular arc side wall 43B and between the other ends of the sub-circular arc side wall 43M and the main circular arc side wall 43B are connected to both straight-line portions of outer edges of the fan-shaped plate portion 43A.

Further, the main circular-arc side wall 43B, the sub-circular arc side wall 43M and the connecting side walls 43C, 43C are all equal in width, and also side faces on both sides in the width direction are flush with each other. As shown in FIG. 10, the slide-contact circular-arc protruding strips 13T, 31T contact with or adjoin so as to be contactable with both side faces of the main circular-arc side wall 43B, thereby preventing lateral displacement of the worm wheel 43.

An oddly-shaped tubular wall 45 is integrally formed on a central part of the circular plate portion 43E so as to penetrate therethrough. The oddly-shaped tubular wall 45 is formed in such a shape that a fan-shaped tubular portion 45B having a fan-shaped cross section protrudes from a part of a circumferential face of a cylindrical portion 45A, and the interior of the cylindrical portion 45A is communicatively connected with the interior of the fan-shaped tubular portion 45B. Further, as shown in FIG. 5, one end face of the oddly-shaped tubular wall 45 is closed by a bottom wall 45C, and a through hole 43H is formed so as to penetrate through the center of the cylindrical portion 45A of the bottom wall 45C. As shown in FIG. 10, the gear supporting shaft 18 is inserted into the cylindrical portion 45A of the oddly-shaped tubular wall 45 through the through hole 43H from the bottom wall 45C, and also the center protrusion portion 35 of the sub-housing 30 is inserted into an opening of the cylindrical portion 45A on the opposite side of the bottom wall 45C. Accordingly, the worm wheel 43 is rotationally movably supported in the housing 11, and the gear portion 43G is positioned in a state of meshing with the worm gear 47. In addition, the circular-arc protrusion piece 34 of the sub-housing 30 (refer to FIG. 5) is overlaid on an outer circumferential face of the fan-shaped tubular portion 45B of the oddly-shaped tubular wall 45 (refer to FIG. 6).

As shown in FIG. 5 and FIG. 6, the turning plate 43F is disposed at a position close to the sub-plate portion 31 in the width direction of the main circular-arc side wall 43B, the connecting side wall 43C or the like. A pair of rotational movement regulating walls 43D, 43D are formed so as to be adjacent to the pair of connecting side walls 43C, 43C at a region of the worm wheel 43 which is closer to the main plate portion 13 than the turning plate 43F of the worm wheel 43 and surrounded by the main circular-arc side wall 43B and the connecting side walls 43C, 43C.

Figure 12:
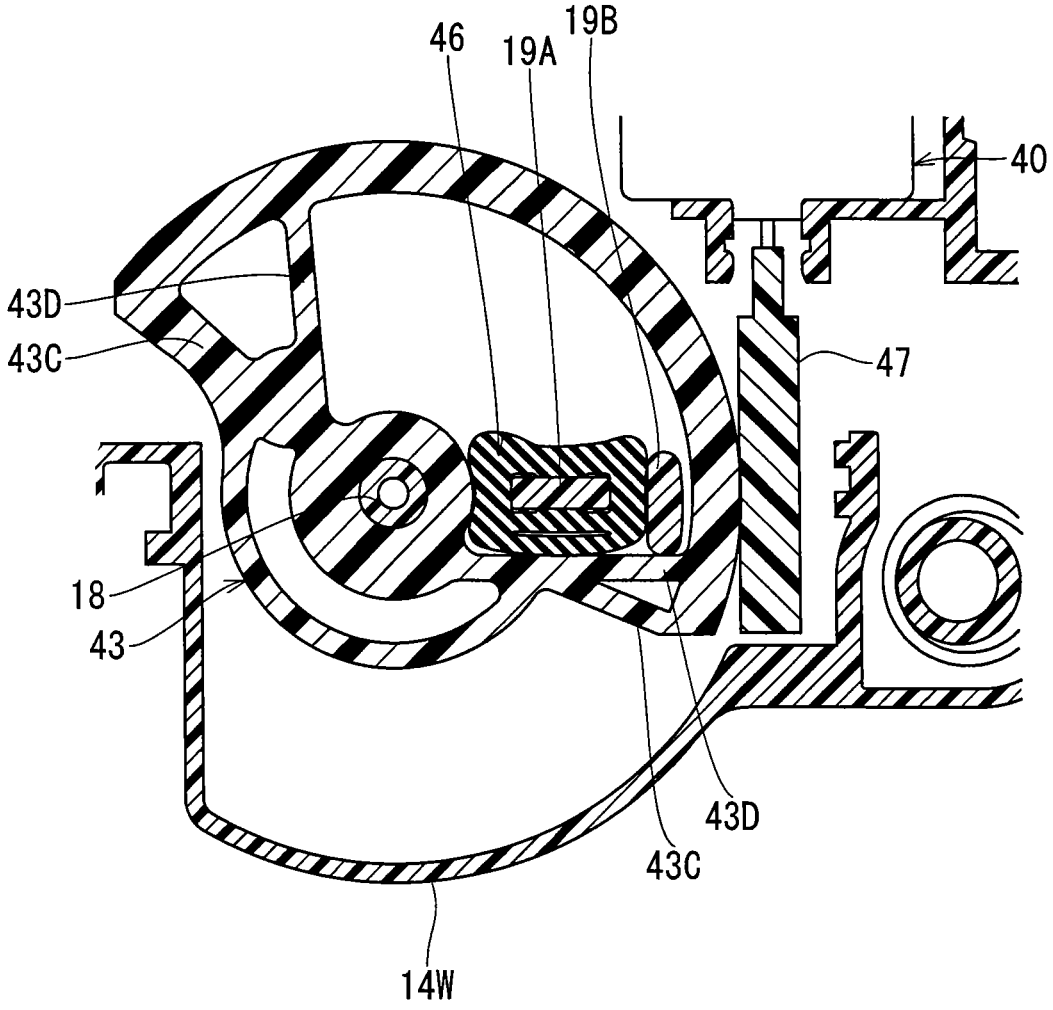
FIG. 12 is a lateral cross-sectional view of the lid locking device in a state that the worm wheel is disposed at a backward rotation limit position.

As shown in FIG. 11, the pair of rotational movement regulating walls 43D, 43D extend so as to be substantially orthogonal to each other and are disposed in such a manner that an intersection point thereof is positioned on the opposite side of the main circular arc side wall 43B in relation to the center of rotational movement of the worm wheel 43. The above-described first and the second rotational movement regulating protrusions 19A, 19B and the cushion rubber 46 are accommodated between the pair of rotational movement regulating walls 43D, 43D. The worm wheel 43 rotates in a clockwise direction when viewed from the sub-plate portion 31, by which one of the rotational movement regulating walls 43D is kept horizontal and in contact with the cushion rubber 46 from above and the worm wheel 43 is positioned at the forward rotation limit position. On the other hand, the worm wheel 43 turns in a counter-clockwise direction when viewed from the sub-plate portion 31, by which, as shown in FIG. 12, the other of the rotational movement regulating walls 43D take substantially horizontal posture and comes in contact with the cushion rubber 46 from below and the worm wheel 43 is positioned at the backward rotation limit position.

As shown in FIG. 11, the rotational movement regulating wall 43D at which the worm wheel 43 is in contact with the cushion rubber 46 at the forward rotation limit position and an end portion close to the center of rotation of the connecting side wall 43C are connected by a complementary portion 43N. A a pressurizing protrusion portion 44 (refer to FIG. 5 and corresponding to both the "pressurizing protrusion portion" and the "pressurizing portion" of the present invention) protrudes from the complementary portion 43N toward the inside of the receiving recessed portion 54 of the locking member 50 (refer to FIG. 6). The pressurizing protrusion portion 44 is provided with a flat face at apart of the circumferential face of a cylindrical body, and when the worm wheel 43 is positioned at the forward rotation limit position, the flat face of the pressurizing protrusion portion 44 is adjacent to the lower groove side wall 15B from above or in contact therewith. Further, at this time, when the locking member 50 is disposed at the origin position as shown in FIG. 15B and FIG. 16B, the pressurizing protrusion portion 44 is in a state of being adjacent to the pressurized face 54A at the rear end of the receiving recessed portion 54.

A description has been so far given of the configuration of the lid locking device 10 of the present embodiment. A description will be given of operation and effects of the lid locking device 10. The lid 94 of the vehicle 90 is normally closed. Therefore, as shown in FIG. 18A, the locking member 50 is normally engaged with the engagement recessed portion 95B of the engagement protrusion piece 95 provided on the lid 94 and disposed at the locking position. Thus, as shown in FIG. 18 B, the detection switch 65 is kept off. Further, as shown in FIG. 11, the worm wheel 43 is disposed at the forward rotation limit position, and the pressurizing protrusion portion 44 is positioned at the front apart from the pressurized face 54A, as shown in FIG. 18B.

In fueling, for example, a lid open switch provided inside the vehicle 90 is operated to open the lid 94. Then, direct current for backward rotation is supplied to the motor 40 only for a predetermined first conducting time. The worm wheel 43 rotates backward and turns from the forward rotation limit position to the backward rotation limit position.

In addition, the vehicle 90 on which the lid locking device 10 of the present invention is mounted may be such that supply of electricity to the motor 40 is started immediately after operation of the lid open switch. Further, the vehicle may be such that, for example, upon operation of the lid open switch, a pressure device inside a fuel tank is first activated to decrease the pressure inside a fuel tank to a specified pressure so that gasified gasoline in excess of a specified quantity is not discharged when the lid 94 is opened and supply of electricity to the motor 40 is thereafter started as in a vehicle which meets the evaporative emission standard.

The worm wheel 43 turns from the forward rotation limit position to the backward rotation limit position, by which the pressurizing protrusion portion 44 moves backward, comes into contact with the pressurized face 54A of the locking member 50 on its way, thereby imparting a backward driving power allowing the locking member 50 to move backward to the pressurized face 54A. In other words, the pressurizing protrusion portion 44 presses the pressurized face 54A backward, by which the locking member 50 moves backward. Before the worm wheel 43 arrives at the backward rotation limit position, the locking member 50 arrives at the unlocked position and the lid 94 is opened outward by elastic force of an elastic member (not illustrated).

Even after arrival of the locking member 50 at the unlocked position, the worm wheel 43 further rotates backward and arrives at the backward rotation limit position, as shown in FIG. 7. Accordingly, the locking member 50 moves up to a part before the rear-end limit position at the unlocked position. As shown in FIG. 12, the above-described first conducting time elapses while the worm wheel 43 is in contact with the cushion rubber 46 and stopped at the backward rotation limit position. This time, direct current for forward rotation is supplied to the motor 40 only for a predetermined second conducting time. By this, the worm wheel 43 rotates reversely (in other words, rotating forward), moving rotationally from the backward rotation limit position to the forward rotation limit position and the pressurizing protrusion portion 44 moves forward. The locking member 50 moves forward in such a manner that the pressurized face 54A follows the pressurizing protrusion portion 44 by elastic force of the torsion coil spring 26. At this time, since the lid 94 is opened, the locking member 50 moves to the origin position. As shown in FIG. 15B, the switch contact portion 53 of the locking member 50 presses the sensor 67 of the detection switch 65 forward, thereby the detection switch 65 is turned on. In response to the turning of the detection switch 65, for example, a warning lamp inside the vehicle 90 is turned on.

After fueling, the lid 94 is pushed manually to be brought to the closed position. The tip guide portion 95C of the engagement protrusion piece 95 provided on the lid 94 presses the tip swelling face 57A at the front end of the locking member 50 and comes slidingly in contact with the tip swelling face 57A. The locking member 50 moves by being pushed backward. Accordingly, the pressurizing protrusion portion 44 makes a relative movement forward inside the interference avoiding space 54S of the receiving recessed portion 54 and is spaced away from the pressurized face 54A. By this, the locking member 50 moves backward, with the worm wheel 43 being stopped. The detection switch 65 is turned off and the warning lamp inside the vehicle 90 is turned off.

When the lid 94 is further pushed to the recessed portion 92, the first rod constituting portion 57 of the locking member 50 passes through the tip guide portion 95C and rides over a position which is close to the tip guide portion 95C from the engagement recessed portion 95B of the rod abutting portion 95A. The locking member 50 arrives at the unlocked position shown in FIG. 17B. As shown in FIG. 17A, when the lid 94 is completely closed to be in a totally closed state, the first rod constituting portions 57 of the locking member 50 opposes to the engagement recessed portion 95B, and the locking member 50 moves forward by elastic force of the torsion coil spring 26. As shown in FIG. 18 A, the tip of the first rod constituting portion 57 comes into contact with an innermost face of the engagement recessed portion 95B. The locking member 50 is positioned at the locking position shown in FIG. 18B. Accordingly, a normal state before fueling is restored.

In addition, where the lid 94 cannot be unlocked by switch operation inside the vehicle 90 due to defects of the motor 40 or the like, the wire W is pulled within the trunk room 96, allowing the locking member 50 to move from the locking position to the unlocked position, by which the lid 94 can be opened.

As described above, in the lid locking device 10 of the present embodiment, the "power transmitting mechanism" of the present invention which is composed of the worm gear 47, the worm wheel 43, the pressurizing protrusion portion 44, the pressurized face 54A and the interference avoiding space 54S is provided between the motor 40 and the locking member 50. By this, as described previously, the backward driving power allowing the locking member 50 to move backward to the unlocked position is transmitted from the motor 40 to the locking member 50 but not transmitted from the locking member 50 to the motor 40 and cut off. That is, the backward driving power which is received by the locking member 50 from the engagement protrusion piece 95 of the lid 94 when the lid 94 is closed is cut off by the power transmitting mechanism and not transmitted to the motor 40. Therefore, when the lid 94 is operated so as to be closed, the motor 40 is not associated with backward moving motions of the locking member 50, thus making it possible to decrease the resistance on closing operation of the lid 94, as compared with a conventional device.

Further, in the lid locking device 10 of the present embodiment, the detection switch 65 is turned on or off, depending on whether the locking member 50 is positioned at the origin position. It is, thereby, possible to detect whether the lid 94 is in an open state or in a closed state. In addition, the switch contact portion 53 which is integrally provided on locking member 50 is in contact with the detection switch 65, by which the detection switch 65 is turned on or off. Therefore, as compared with a case where a component in association with the locking member 50 is in contact with the detection switch 65 to turn the detection switch 65 on or off, it is possible to suppress deviation and variation in arrival timing of the locking member 50 at the origin position and on/off timing of the detection switch 65. It is also possible to accurately detect the open state and the closed state of the lid 94.

Further, the switch contact portion 53 which turns the detection switch 65 on is in contact with the contacting protruding strip 17T of the vertical partition wall 17 formed on the housing 11, thereby regulating an excessive pushing-in of the sensor 67 by the switch contact portion 53. Still further, the contacting protruding strip 17T is disposed so as to be adjacent to the detection switch 65 and the main body portion of the locking member 50 (more specifically, a part excluding the switch contact portion 53 and the side head portion 52 of the locking member 50) between the detection switch 65 and the main body portion of the locking member 50. It is, thereby, possible to suppress a variation in the pushing-in regulating amount of the sensor 67 by the contacting protruding strip 17T.

Further, in the lid locking device 10 of the present embodiment, a group of electrical components such as an electrically conductive portion of the detection switch 65 and the motor 40 and the first to the third bus bars 68X, 68Y, 68Z (refer to FIG. 5 and FIG. 6) connected thereto is accommodated in the upper-side accommodating portion 11U (refer to FIG. 3) of the housing 11 which is above the guide groove portion 15 linearly movably supporting the locking member 50. On the other hand, a group of non-electrical components such as the torsion coil spring 26 which urges the locking member 50 to the origin position and the gear supporting shaft 18 of the worm wheel 43 (refer to FIG. 5 and FIG. 6) is accommodated in the lower-side accommodating portion 11D which is below the guide groove portion 15 (refer to FIG. 3). As described so far, in the lid locking device 10 of the present embodiment, the group of electrical components and the group of non-electrical components are accommodated in a vertically separated manner. Therefore, assembly work can be done easily. Further, since the group of electrical components is disposed at an upper part, it is possible to prevent a short circuit by water entering into the housing 11.

Second Embodiment

Figure 19:
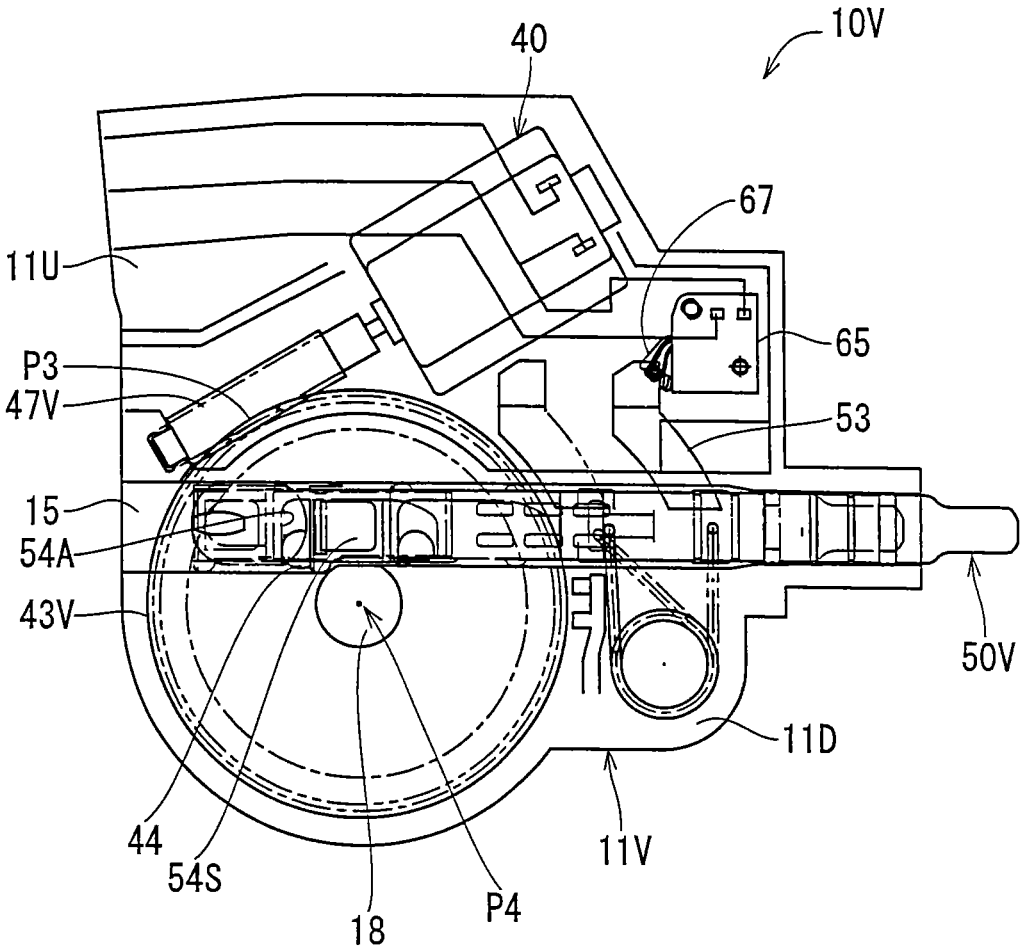
FIG. 19 is an internal side view of the lid locking device of a Second Embodiment.

In the lid locking device 10 of the above-described First Embodiment, the worm gear 47 comes across the guide groove portion 15 and the worm gear 47 is accommodated in the lower-side accommodating portion 11D of the housing 11 which is lower than the guide groove portion 15 (refer to FIG. 7 and FIG. 8). However, in a lid locking device 10V of the present embodiment, as shown in FIG. 19, the rotating shaft of a motor 40 inclines in the vertical direction, and a worm gear 47V is accommodated in an upper-side accommodating portion 11U above the guide groove portion 15 of the housing 11V. Further, a worm wheel 43V is formed in a circular shape and meshes with the worm gear 47V above at an obliquely backward position of a gear supporting shaft 18. A pressurizing protrusion portion 44 is disposed on a line which connects a position at which the worm gear 47V meshes with the worm wheel 43V and the rotating center P4 of the worm wheel 43V or in the vicinity thereof. Further, as with the lid locking device 10 of the First Embodiment, the lid locking device 10V of the present embodiment is also provided with a power transmitting mechanism which is composed of the worm gear 47V, the worm wheel 43V, the pressurizing protrusion portion 44, a pressurized face 54A and an interference avoiding space 54S.

Figure 20A:
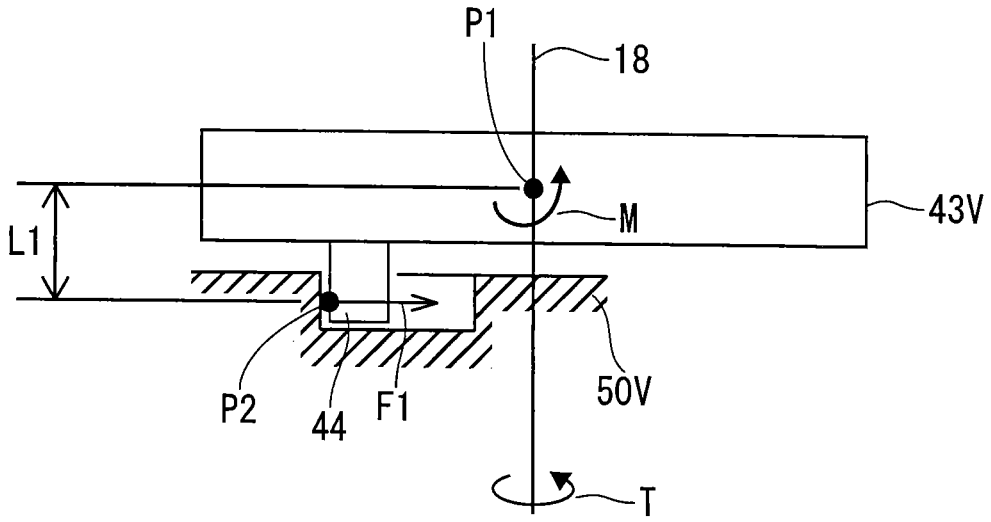
FIG. 20A is a conceptual diagram which shows loads which are applied to the worm wheel.
Figure 20B:
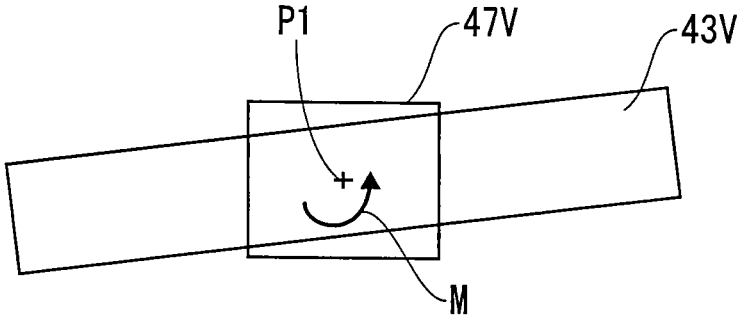
FIG. 20B is a conceptual diagram which shows an inclination of the worm wheel with respect to the worm gear.

In addition to the same working effects as those of the above-described First Embodiment, the above constituted lid locking device 10V also provides the following effects. That is, as shown in FIG. 20A, a contact position P1 of the worm wheel 43V with the gear supporting shaft 18 is spaced away from a contact position P2 of the locking member 50V with the pressurizing protrusion portion 44 by a predetermined distance L1 in an axial direction of the gear supporting shaft 18. Therefore, when the pressurizing protrusion portion 44 receives a load F1 from the locking member 50V, the load F1 not only acts on the worm wheel 43V as loading torque T around the gear supporting shaft 18 but also acts as loading moment M which allows the worm wheel 43V to incline about the center of the contact position P1. On the other hand, in the present embodiment, the pressurizing protrusion portion 44 is disposed on a line which connects a meshing position P3 at which the worm gear 47V meshes with the worm wheel 43V (refer to FIG. 19) and the rotating center P4 of the worm wheel 43V or in the vicinity thereof. Therefore, as shown in FIG. 20B, even when the worm wheel 43V is inclined by the above-described loading moment M, there is no change in position at which the worm gear 47V meshes. It is, thereby, possible to transmit power stably between the worm gear 47V and the worm wheel 43V.

Other Embodiments

The present invention shall not be limited to the embodiments so far described. For example, embodiments which will be described as follows are also included in a technical scope of the present invention. In addition, the present invention may be modified in various ways within a scope not departing from the gist of the present invention.

(1) The lid locking device 10 of the above-described First Embodiment is used to lock the lid 94 which closes the recessed portion 92 having the fuel filler opening 91 at an innermost part. The present invention may be applicable to, for example, a power receiving connector for charging batteries of an electric vehicle, a hydrogen fuel filler opening of a fuel-cell vehicle and other lid locking device for locking a lid which closes an opening of a recessed portion having an energy obtaining portion at an innermost side. The present invention may also be applicable to a lid locking device which locks a lid other than an energy obtaining portion of a vehicle.

(2) The above-described First Embodiment is arranged in such a manner that the locking member 50 of the lid locking device 10 moves forward to the front of the vehicle 90 and is engaged with the engagement protrusion piece 95 of the lid 94. Such an arrangement is also acceptable that the locking member 50 of the lid locking device 10 moves forward to the rear, upward or downward position of vehicle 90 and is engaged with the lid 94. That is, in the present invention, "front" or "forward" contained in expressions such as "at the front" or "move forward" expresses, for the sake of convenience, one direction in which the locking member moves, whereas "rear" or "backward" contained in expressions such as "in the rear of" or "move backward" expresses a direction opposite to the above-described expression of "front" or "forward." These expressions such as "front" "forward," "rear" and "backward" have nothing to do with the front and the rear of a vehicle.

(3) The lid locking device 10 of the above-described First Embodiment is arranged in such a manner that the sensor 67 of the detection switch 65 is pressed by the switch contact portion 53 of the locking member 50, thereby turning the detection switch 65 on or off. Such an arrangement is acceptable that, for example, a sensor is allowed to protrude from a detection switch to the side of a locking member and an angular switch contact portion provided on a side face of the locking member is allowed to come slidingly in contact with the sensor, thereby turning the detection switch on or off. However, the above-described arrangement of First Embodiment is better in suppressing a variation in timing of turning the detection switch on or off than the above-described arrangement.

Figure 21:
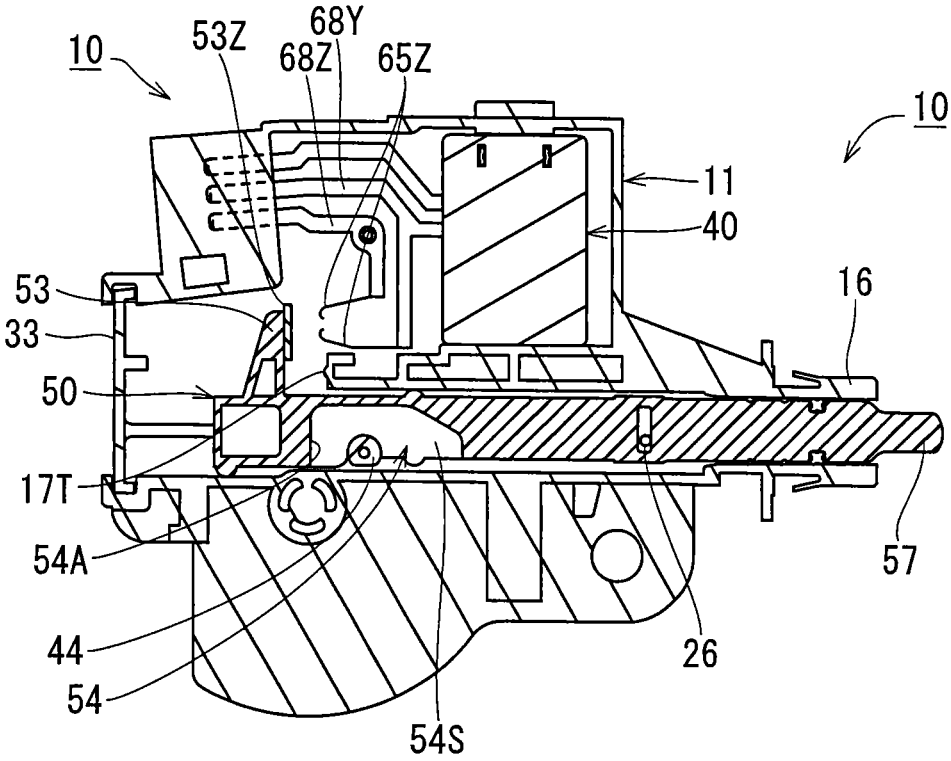
FIG. 21 is a lateral cross-sectional view which shows the lid locking device of a modified example of the present invention.

(4) It is also acceptable that a part of the detection switch is arranged by using the locking member. That is, as shown in FIG. 21, it is acceptable that an electrically conductive member 53Z is installed on the switch contact portion 53 of the locking member 50 and in place of the above-described detection switch 65, a pair of tongue pieces 65Z, 65Z is extended from the second and the third bus bar 68Y, 68Z and allowed to protrude backward to a slightly greater amount than the contacting protruding strip 17T, and the electrically conductive member 53Z and the pair of tongue pieces 65Z, 65Z are used to arrange the "detection switch" of the present invention. Even in the above arrangement, when the locking member 50 moves to the origin position, the electrically conductive member 53Z makes conductive a space between the tongue pieces 65Z, 65Z, thereby turning the "detection switch" on.

Figure 22A:
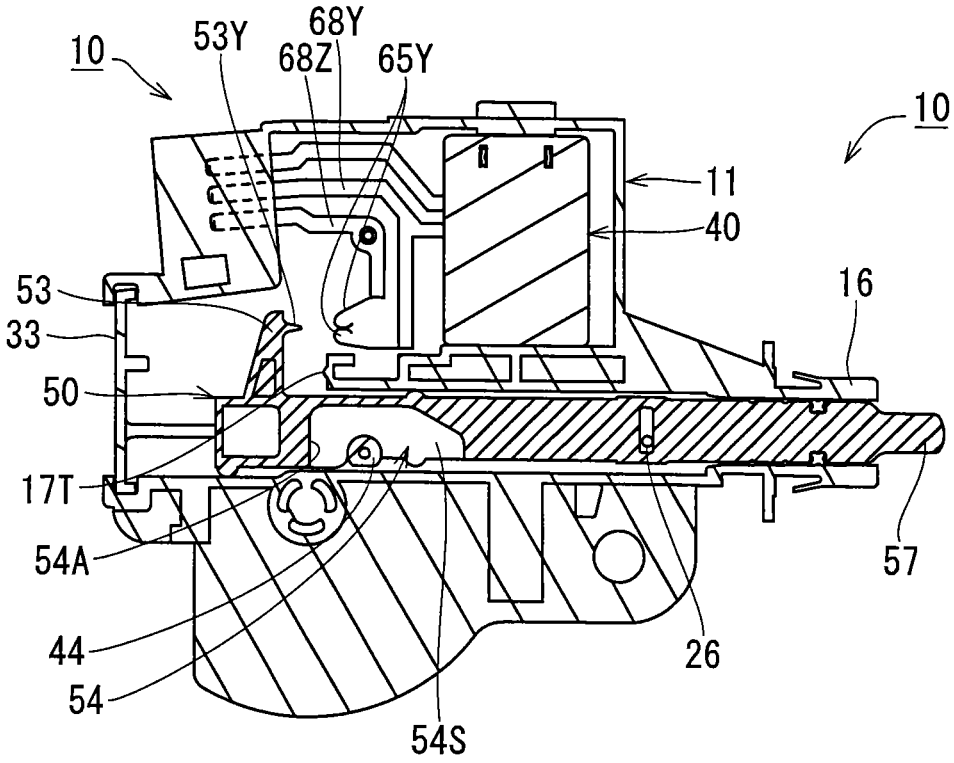
FIG. 22A is a lateral cross-sectional view which shows the lid locking device of the modified example of the present invention.
Figure 22B:
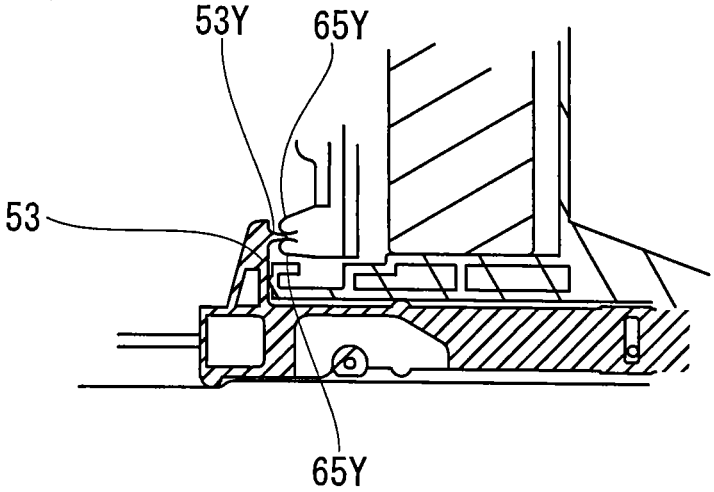
FIG. 22B is a lateral cross-sectional view which shows a state that a detection switch of the lid locking device is turned off.

(5) The detection switch 65 of the above-described embodiment is arranged in such a manner that the locking member 50 is turned on in a state of being disposed at the origin position and turned off when being spaced away from the origin position. Such an arrangement is acceptable that in reverse, the locking member is turned off in a state of being disposed at the origin position and turned on when being spaced away from the origin position. More specifically, in a state that the sensor 67 is not pressed by the switch contact portion 53, a space between the second and the third bus bar 68Y, 68Z inside the detection switch 65 is connected so as to be electrically conductive by a movable piece (not illustrated), and when the locking member 50 moves to the origin position and the sensor 67 is pressed by the switch contact portion 53, the movable piece moves to separate the second bus bar 68Y from the third bus bar 68Z. Further, as shown in FIG. 22A, such an arrangement is also acceptable that a pair of tongue pieces 65Y, 65Y are extended from the second and the third bus bar 68Y, 68Z and allowed to be in contact with each other, and as shown in FIG. 22B, when the locking member 50 moves to the origin position, an insulation protrusion piece 53Y which protrudes from the switch contact portion 53 cuts into a pair of tongue pieces 65Y, 65Y, thereby separating one from the other.

(6) In the above-described embodiment, the "unlocked position" of the present invention, that is, a terminal position at which the locking member 50 moves backward by power from the drive source (motor 40) is shifted from a terminal position at which the locking member 50 is pressed by the engagement protrusion piece 95 of the lid 94 and moves backward. However, it is acceptable that these positions are in agreement.

(7) In the above-described First Embodiment, the power of the motor 40 is transmitted by way of the worm gear 47 and the worm wheel 43 to the locking member 50. It is acceptable that the power of the motor is transmitted by way of a rack and pinion to the locking member or it is also acceptable that the power of the motor is transmitted by way of a cam mechanism or a lever link mechanism to the locking member.

In addition, although not included in the technical scope of the present invention, the arrangement of the above-described Second Embodiment may be applicable to a lid locking device having a structure which is free of the interference avoiding space or the like. It is also acceptable that technology by which a part of the detection switch is arranged by the above-described locking member is applicable to a lid locking device having a structure which is free of the above-described interference avoiding space or the like.

DESCRIPTION OF REFERENCE NUMERALS

10, 10V: lid locking device
11, 11V: housing
11D: lower-side accommodating portion
11U: upper-side accommodating portion
12: main housing
15: guide groove portion
17T: contacting protruding strip (stopper)
18: gear supporting shaft (rotational movement center shaft)
23: male connector hood
26 torsion coil spring (urging spring)
30: sub-housing
40: motor (drive source)
47: worm gear
50: locking member
53: switch contact portion
54: receiving recessed portion
54A: pressurized face
54S: interference avoiding space
65: detection switch
67: sensor
68X, 68Y, 68Z: first to third bus bar
90: vehicle
94: lid
95: engagement protrusion piece (locking engaging portion)

What is claimed is:

1. A lid locking device, comprising:

a housing which is arranged so as to be fixed on a vehicle;

a locking member which is arranged in such a manner that it is assembled to the housing so as to be movable, urged to an origin position in its moving range and arranged so as to move backward, in a process of closing a lid of the vehicle, by being pressed by a locking engaging portion provided on the lid, and then to move forward to a locking position before the origin position, thereby locking the lid in a closed state;

a motor which is assembled to the housing and outputs power for allowing the locking member at the locking position to move backward to an unlocked position at which the lid is unlocked;

a power transmitting mechanism which connects between the motor and the locking member and transmits power from the motor to the locking member when the locking member is moved backward to the unlocked position but does not transmit power from the locking member to the motor and cuts off the power, the power transmitting mechanism including:

a worm gear, a worm wheel, a pressing protrusion portion, a face to be pressed, and an interference avoiding space;

a detection switch which is assembled to the housing and turned on or off depending on whether or not the locking member is positioned at the origin position; and a switch contact portion which is provided to move as one with the locking member and comes into contact with the detection switch or releases the contact when the locking member moves to the origin position, thereby turning the detection switch on or off.

2. The lid locking device according to claim 1, further comprising:

the switch contact portion protruding laterally from the locking member; and the detection switch disposed at a lateral side of the locking member, provided with a sensor in the rear thereof, and turned on or off by the sensor being pressed forward by the switch contact portion.

3. The lid locking device according to claim 1, further comprising:

a guide groove portion which is provided on the housing and linearly movably supports the locking member;

a connector portion which is provided on an outer face above the guide groove portion of the housing;

a plurality of bus bars which are connected to electrically-conductive portions of the detection switch and the motor, and one end of which is also given as a terminal fitting inside the connector portion; and an upper-side accommodating portion which is provided above the guide groove portion of the housing and accommodates the electrically conductive portions of the detection switch and the motor as well as the plurality of bus bars.

4. The lid locking device according to claim 1, wherein the pressing protrusion portion is positioned at a first position and is moved to a second position located more rearward from the first position along a moving direction of the locking member by receiving power of the motor, and the face to be pressed moves as one with the locking member and opposes the pressing protrusion portion at the first position from a rear side.

5. The lid locking device according to claim 2, further comprising:

the detection switch which is disposed so that the sensor is able to move further forward from a state that the sensor is pressed by the switch contact portion of the locking member at the origin position; and a stopper which is formed on the housing, comes in contact with the switch contact portion upon movement of the locking member to the origin position, and positions the locking member at the origin position.

6. The lid locking device according to claim 2, further comprising:

a guide groove portion which is provided on the housing and linearly movably supports the locking member;

a connector portion which is provided on an outer face above the guide groove portion of the housing;

a plurality of bus bars which are connected to electrically-conductive portions of the detection switch and the motor, and one end of which is also given as a terminal fitting inside the connector portion; and an upper-side accommodating portion which is provided above the guide groove portion of the housing and accommodates the electrically conductive portions of the detection switch and the motor as well as the plurality of bus bars.

7. The lid locking device according to claim 5, further comprising:

the stopper disposed so as to be adjacent to the detection switch and a main body portion of the locking member between the detection switch and the main body portion of the locking member.

8. The lid locking device according to claim 5, further comprising:

a guide groove portion which is provided on the housing and linearly movably supports the locking member;

a connector portion which is provided on an outer face above the guide groove portion of the housing;

a plurality of bus bars which are connected to electrically-conductive portions of the detection switch and the motor, and one end of which is also given as a terminal fitting inside the connector portion; and an upper-side accommodating portion which is provided above the guide groove portion of the housing and accommodates the electrically conductive portions of the detection switch and the motor as well as the plurality of bus bars.

9. The lid locking device according to claim 7, further comprising:

a guide groove portion which is provided on the housing and linearly movably supports the locking member;

a connector portion which is provided on an outer face above the guide groove portion of the housing;

a plurality of bus bars which are connected to electrically-conductive portions of the detection switch and the motor, and one end of which is also given as a terminal fitting inside the connector portion; and an upper-side accommodating portion which is provided above the guide groove portion of the housing and accommodates the electrically conductive portions of the detection switch and the motor as well as the plurality of bus bars.

10. A lid locking device, comprising:

a housing which is arranged so as to be fixed on a vehicle;

a locking member which is arranged in such a manner that it is assembled to the housing so as to be movable, urged to an origin position in its moving range and arranged so as to move backward, in a process of closing a lid of the vehicle, by being pressed by a locking engaging portion provided on the lid, and then to move forward to a locking position before the origin position, thereby locking the lid in a closed state;

a drive source which is assembled to the housing and outputs power for allowing the locking member at the locking position to move backward to an unlocked position at which the lid is unlocked;

a power transmitting mechanism which connects between the drive source and the locking member and transmits power from the drive source to the locking member when the locking member is moved backward to the unlocked position but does not transmit power from the locking member to the drive source and cuts off the power;

a detection switch which is assembled to the housing and turned on or off depending on whether or not the locking member is positioned at the origin position;

a switch contact portion which is provided integrally on the locking member and comes into contact with the detection switch or releases the contact when the locking member moves to the origin position, thereby turning the detection switch on or off;

a guide groove portion which is provided on the housing and linearly movably supports the locking member;

a connector portion which is provided on an outer face above the guide groove portion of the housing;

a plurality of bus bars which are connected to electrically-conductive portions of the detection switch and the drive source, and one end of which is also given as a terminal fitting inside the connector portion;

an upper-side accommodating portion which is provided above the guide groove portion of the housing and accommodates the electrically conductive portions of the detection switch and the drive source as well as the plurality of bus bars;

an urging spring which urges the locking member to the origin position;

a motor which is the drive source;

a worm gear which is fixed to an output rotating shaft of the motor and extends downward from the motor by coming across the guide groove portion laterally;

a worm wheel which meshes with the worm gear and also partially overlaps with a side face of the locking member;

a lower-side accommodating portion which is provided below the guide groove portion of the housing and accommodates a rotational movement center shaft of the worm wheel and the urging spring;

a pressing protrusion portion which protrudes from a side face of the worm wheel;

a face to be pressed which is provided on the locking member and adjacent to the rear of the pressing protrusion portion when the locking member is disposed at the origin position, and receiving from the pressing protrusion portion the power allowing the locking member to move backward to the unlocked position;

an interference avoiding space which is provided at the front of the face to be pressed of the locking member and avoids interference of the pressing protrusion portion with the locking member when the locking member is moved backward in a state that the pressing protrusion portion has been stopped; and the power transmitting mechanism including the worm gear, the worm wheel, the pressing protrusion portion, the face to be pressed and the interference avoiding space.

11. The lid locking device according to claim 10, further comprising:

the switch contact portion protruding laterally from the locking member; and the detection switch disposed at a lateral side of the locking member, provided with a sensor in the rear thereof, and turned on or off by the sensor being pressed forward by the switch contact portion.

12. The lid locking device according to claim 11, further comprising:

the detection switch which is disposed so that the sensor is able to move further forward from a state that the sensor is pressed by the switch contact portion of the locking member at the origin position; and a stopper which is formed on the housing, comes in contact with the switch contact portion upon movement of the locking member to the origin position, and positions the locking member at the origin position.

13. The lid locking device according to claim 12, further comprising:

the stopper disposed so as to be adjacent to the detection switch and a main body portion of the locking member between the detection switch and the main body portion of the locking member.

14. A lid locking device, comprising:

a housing which is arranged so as to be fixed on a vehicle;

a locking member which is arranged in such a manner that it is assembled to the housing so as to be movable, urged to an origin position in its moving range and arranged so as to move backward, in a process of closing a lid of the vehicle, by being pressed by a locking engaging portion provided on the lid, and then to move forward to a locking position before the origin position, thereby locking the lid in a closed state;

a drive source which is assembled to the housing and outputs power for allowing the locking member at the locking position to move backward to an unlocked position at which the lid is unlocked;

a power transmitting mechanism which connects between the drive source and the locking member and transmits power from the drive source to the locking member when the locking member is moved backward to the unlocked position but does not transmit power from the locking member to the drive source and cuts off the power;

a detection switch which is assembled to the housing and turned on or off depending on whether or not the locking member is positioned at the origin position;

a switch contact portion which is provided integrally on the locking member and comes into contact with the detection switch or releases the contact when the locking member moves to the origin position, thereby turning the detection switch on or off;

a rotational-movement transmitting component which receives power from the drive source and rotates;

a pressing portion which is provided on the rotational movement transmitting component and moves back and forth, assuming a circular arc along a linear movement direction of the locking member in association with the rotational movement of the rotational movement transmitting component;

a face to be pressed which is provided on the locking member and adjacent to the rear of the pressing portion when the locking member is disposed at the origin position, and receives from the pressing portion the power allowing the locking member to move backward to the unlocked position;

an interference avoiding space which is provided at the front of the face to be pressed of the locking member and avoids interference of the pressing portion with the locking member when the locking member is moved backward in a state that the pressing portion has been stopped; and the power transmitting mechanism including the rotational movement transmitting component, the pressing portion, the face to be pressed and the interference avoiding space.

15. The lid locking device according to claim 14, further comprising:

the switch contact portion protruding laterally from the locking member; and the detection switch disposed at a lateral side of the locking member, provided with a sensor in the rear thereof, and turned on or off by the sensor being pressed forward by the switch contact portion.

16. The lid locking device according to claim 14, further comprising:

a guide groove portion which is provided on the housing and linearly movably supports the locking member;

a connector portion which is provided on an outer face above the guide groove portion of the housing;

a plurality of bus bars which are connected to electrically-conductive portions of the detection switch and the drive source, and one end of which is also given as a terminal fitting inside the connector portion; and an upper-side accommodating portion which is provided above the guide groove portion of the housing and accommodates the electrically conductive portions of the detection switch and the drive source as well as the plurality of bus bars.

17. The lid locking device according to claim 16, further comprising:

the switch contact portion protruding laterally from the locking member; and the detection switch disposed at a lateral side of the locking member, provided with a sensor in the rear thereof, and turned on or off by the sensor being pressed forward by the switch contact portion.

18. The lid locking device according to claim 17, further comprising:

the detection switch which is disposed so that the sensor is able to move further forward from a state that the sensor is pressed by the switch contact portion of the locking member at the origin position; and a stopper which is formed on the housing, comes in contact with the switch contact portion upon movement of the locking member to the origin position, and positions the locking member at the origin position.

19. The lid locking device according to claim 18, further comprising:

the stopper disposed so as to be adjacent to the detection switch and a main body portion of the locking member between the detection switch and the main body portion of the locking member.

20. The lid locking device according to claim 15, further comprising:

the detection switch which is disposed so that the sensor is able to move further forward from a state that the sensor is pressed by the switch contact portion of the locking member at the origin position; and a stopper which is formed on the housing, comes in contact with the switch contact portion upon movement of the locking member to the origin position, and positions the locking member at the origin position.

21. The lid locking device according to claim 20, further comprising:

the stopper disposed so as to be adjacent to the detection switch and a main body portion of the locking member between the detection switch and the main body portion of the locking member.

* * * * *